US012611580B2

(12) United States Patent
Lalaoua

(10) Patent No.: US 12,611,580 B2
(45) Date of Patent: Apr. 28, 2026

(54) FREESTANDING STRUCTURAL DISPLAY APPARATUS FOR SPORT GOALPOST

(71) Applicant: Nabile Lalaoua, Las Vegas, NV (US)

(72) Inventor: Nabile Lalaoua, Las Vegas, NV (US)

( * ) Notice: Subject to any disclaimer, the term of this patent is extended or adjusted under 35 U.S.C. 154(b) by 824 days.

(21) Appl. No.: 17/978,888

(22) Filed: Nov. 1, 2022

(65) Prior Publication Data

US 2023/0047129 A1 Feb. 16, 2023

Related U.S. Application Data

(63) Continuation-in-part of application No. 16/588,337, filed on Sep. 30, 2019, now Pat. No. 11,484,758.

(51) Int. Cl.
*A63B 63/00* (2006.01)
*A63B 71/06* (2006.01)

(52) U.S. Cl.
CPC ..... *A63B 63/00* (2013.01); *A63B 71/06* (2013.01); *A63B 2071/0694* (2013.01); *A63B 2225/74* (2020.08)

(58) Field of Classification Search
CPC . A63B 63/00; A63B 71/06; A63B 2071/0694; A63B 2225/74; A63B 71/022; A63B 71/023; A63B 71/0622; A63B 2024/0028; A63B 2071/0063; A63B 2071/0625; A63B 2071/0638; A63B 2071/0658; A63B 2209/00; A63B 2220/803; A63B 2220/806; A63B 2220/833; A63B 2225/09; A63B 2225/50; G09F 19/22; G09F 23/0066; G09F 15/0037; G09F 2013/222
See application file for complete search history.

(56) References Cited

U.S. PATENT DOCUMENTS 1,923,152 A * 8/1933 Kohn ..... A63B 63/00 473/190
4,492,049 A * 1/1985 Gaylor ..... G09F 23/00 40/607.01
5,615,880 A 4/1997 Booth
6,494,455 B1 * 12/2002 Headrick ..... A63B 63/00 273/400
7,115,053 B2 * 10/2006 Meichner ..... A63B 63/00 473/477
9,233,294 B1 * 1/2016 Coyle ..... A63B 69/0013
(Continued)

*Primary Examiner* — Jeffrey S Vanderveen

(57) ABSTRACT

A freestanding structural display apparatus for sport goalpost includes a freestanding media structure, a main computing device, and a sporting game-scoring structure. The freestanding media structure includes a frame, a control room, a hospitality suite, a plurality of display panels, a lower display ring, and a plurality of output panels. The frame is fully enclosed by the plurality of display panel and the plurality of output panels. The lower display ring is laterally connected around the frame at the ground level. The control room and hospitality suite are internally connected to the frame as the main computing device is positioned within the control room. The sporting game-scoring structure is connected to the frame and positioned atop a top panel of the plurality of display panels. The lower display ring, the plurality of output panels, and the game-scoring structure are electrically connected to the main computing device thus allowing multiple game-plays.

27 Claims, 35 Drawing Sheets

(56) References Cited

U.S. PATENT DOCUMENTS

| | | | | |
|---|---|---|---|---|
| 9,943,737 | B1 * | 4/2018 | Burdan | A63H 33/18 |
| 10,857,437 | B2 | 12/2020 | Lalaoua | |
| 10,926,144 | B2 | 2/2021 | Lalaoua | |
| 2014/0100062 | A1 * | 4/2014 | Terrell | A63B 63/004<br>473/476 |
| 2016/0096096 | A1 * | 4/2016 | Bowman | A63B 63/00<br>473/478 |
| 2020/0376356 | A1 * | 12/2020 | Cardoso | A63B 63/004 |

* cited by examiner

FREESTANDING STRUCTURAL DISPLAY APPARATUS FOR SPORT GOALPOST

The current application is a continuation-in-part (CIP) application of the U.S. non-provisional application Ser. No. 16/588,337 filed on Sep. 30, 2019.

FIELD OF THE INVENTION

The present invention relates generally to sport field equipment and accessories. More specifically, the present invention is a freestanding media structure display, built for sport competition with the use of the field goalpost and many electronic technologies.

The present invention offers modern solution for next generation sport athletes and fans. With the exterior surface of the structural display includes advertising panel displays, signage perimeter ring, cameras, and projector devices and in the interior includes a control room to operate all the electronic devices, adverting display and referee goal scoring signal, fan engagement entertainment celebration announcement and a luxury hospitality suits for occupancy by persons and sport fans and press, all to that enables different sport games and competitions play with any ball and any number of athletes play on outdoor and indoor pitches in any outdoor stadiums or indoor arenas with an integrated game-scoring structure and advertising, with the option of implementing and two different player platform displays.

The present invention and technology design to launch new sport discipline involving any ball and rules to create next generation sport competitions such as the football field goal kick competition and football hand throw quarterback target competitions, target handball competitions to name a few play on any pitches with different field and team players configuration between the goalpost frame and the players positioned and distance of kicking and throw, in any outdoor and indoor stadiums and arenas.

The present invention and technology also a great solution to launch a large variety of new sports activities and games play outdoor and indoor for youth and kids and group sports activities for adults to perform kicking and throw of any ball to the target goalpost, including target practice games, with the invention benefits to be placed anywhere on any hard floor or grass ground surface using ang base support frame.

The present invention and technology can be implemented to traditional sport, such as American football, college football, soccer, rugby, basketball, handball, and other similar sports, and also to better serve their fanbase with the sport of field goal kick championship and National field goal championship.

Additionally, the present invention is designed to replace of traditional goalpost frame with next generation goalpost technology for sport of American football, rugby, soccer, futsal, handball, baseball, cricket, lacrosse, and other similar sports.

The present invention includes a large variety of outstanding technology such as video advertising screen display and goal scoring goal system-digital signage sponsor display, electronic advertising screen panels designed to create exceptional branding visibility, and fan engagement solution.

The present invention includes camera technology that involves the recording and playing back of moving pictures and sound from the freestanding structural display apparatus for sport goalpost is mainly use during live sporting events for video production, television broadcasting, live streaming technology, OTT (over-the-top), media and digital service, such as mobile app service, social media performs with the video content can be display directly on the freestanding structural display apparatus and screen in real time.

The present invention and camera technology is also used for game video assistance to offer better understanding between referee and fans. Instead of a single referee reviewing and making all decisions. Now, live audience can participate in decision-making during live matches. Now, the referee, fans, and players can view replay in slow motion directly from the structural screen displays and, allowing them to advise the official pitch referee with fan input, can view replay in slow motion, which allows them to give their opinion on the final decision.

BACKGROUND OF THE INVENTION

American football, herein referred to as football, is the fastest-growing sport in the world. Combined with rugby's already internationally-established reputation, a significant amount of international viewing time is devoted to watching these two sports. In order to provide meaningful investments to owners and expensive athlete salaries, companies may pay for advertising and promotional materials to appear during games, which results in a large number of potential customers' eyes on the promoted product. To accomplish such a task, advertisement space is created all over the field. Such space is a highly valuable asset to a rugby or football team owner for generating additional advertisement revenue. Particularly teams in the National Football League (NFL), the National Rugby League (NRL), the National Collegiate Athletic Association (NCAA), or other such professional athletics organizations would have interest in providing accommodations for additional advertisements. Coincidentally, both football and rugby utilize a field with opposing end zones and goal lines with two parallel lines that designate the end of the pitch, each with a goalpost, for scoring. The goalpost provides significant, currently untouched opportunity for generation of advertisements as football or rugby goalposts can be utilized prime advertisement, event information, and to further enhance game experience.

The present invention offers new solutions and important improvements that includes a new safety system and a new advertising display designed with today's technology in order to increase branding visibility for the sponsor with the delivery for modern fan engagement experience during live sport events and to enhance the quality of the game and the health of the players. More specifically, the present invention provides a novel means of integrating advertisement, logos, three-dimension projector devices, lights and siren systems for goal scoring signal and fans engagement celebration and entertainment, and cameras in and around a freestanding media structure and a game-scoring structure mostly using for live broadcasting and digital service. These features allow the audience and the players to experience the sport from a novel perspective. For example, the present invention includes a plurality of lights to visually indicate the current score of the game. Additionally, siren horns are also used to announce the official scoring goal. Furthermore, the present invention includes a variety of LOGO projectors and electronic screens which visually display information and or advertisement can be displayed directly from the structural display to the audience and or players. The game-scoring structure is mounted to the freestanding media structure as the game-scoring structure can be a foldable lighting upright post of goal post or an annular target post.

Furthermore, a telescopic support arm of the goalpost frame slides the goalpost in and out of an advertising displaying freestanding media structure to change or adjust safety distance between the line mark and front soft padding digital panel of the media structure. The present invention also enables newer type of games to be played due to the mobility of the freestanding media structure and the player platforms displays.

DETAIL DESCRIPTIONS OF THE INVENTION

Figure 1:
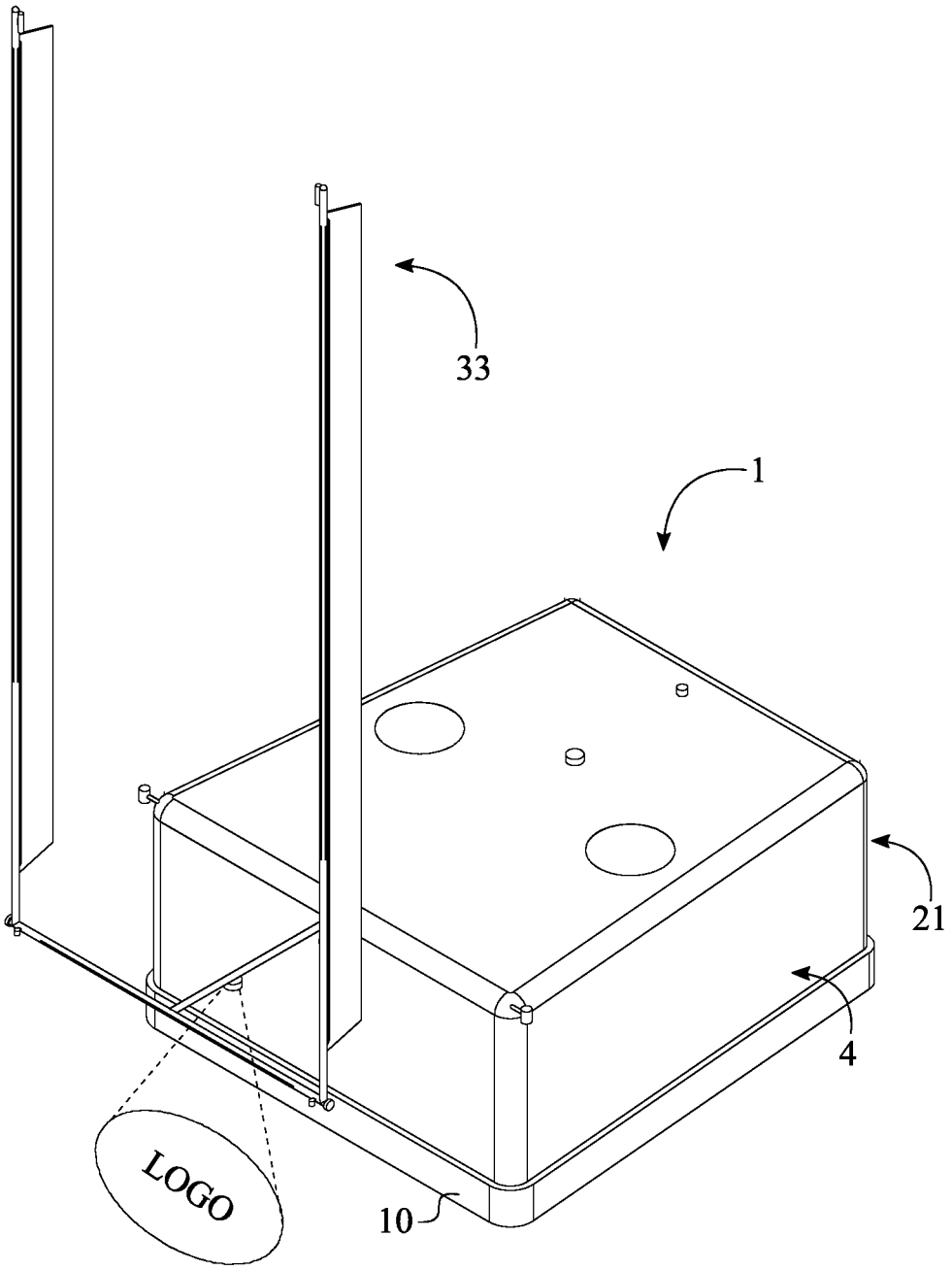
FIG. 1 is a perspective view of the present invention showing the foldable goal post.
Figure 2:
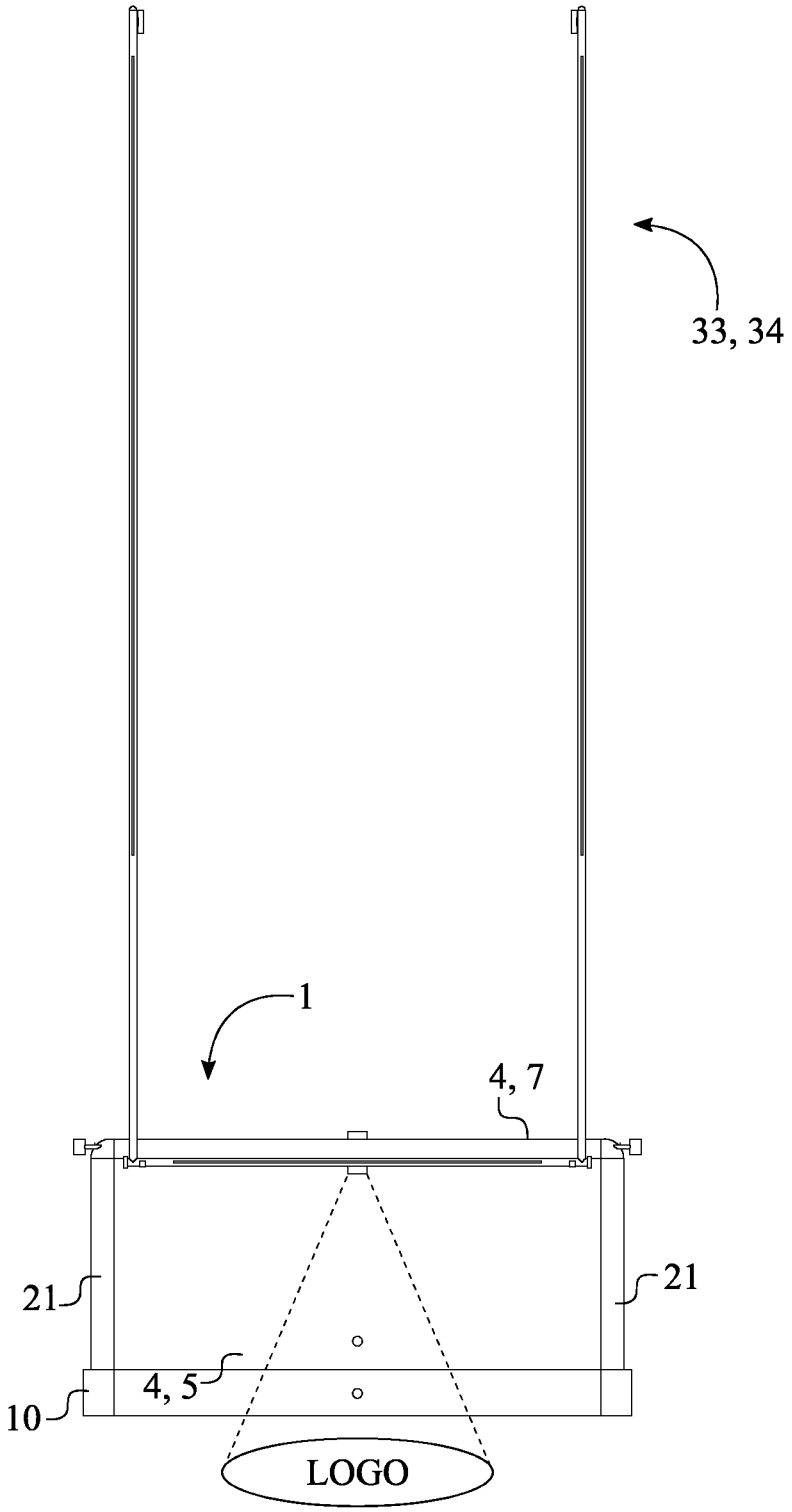
FIG. 2 is a front view of the present invention showing the foldable goal post.
Figure 3:
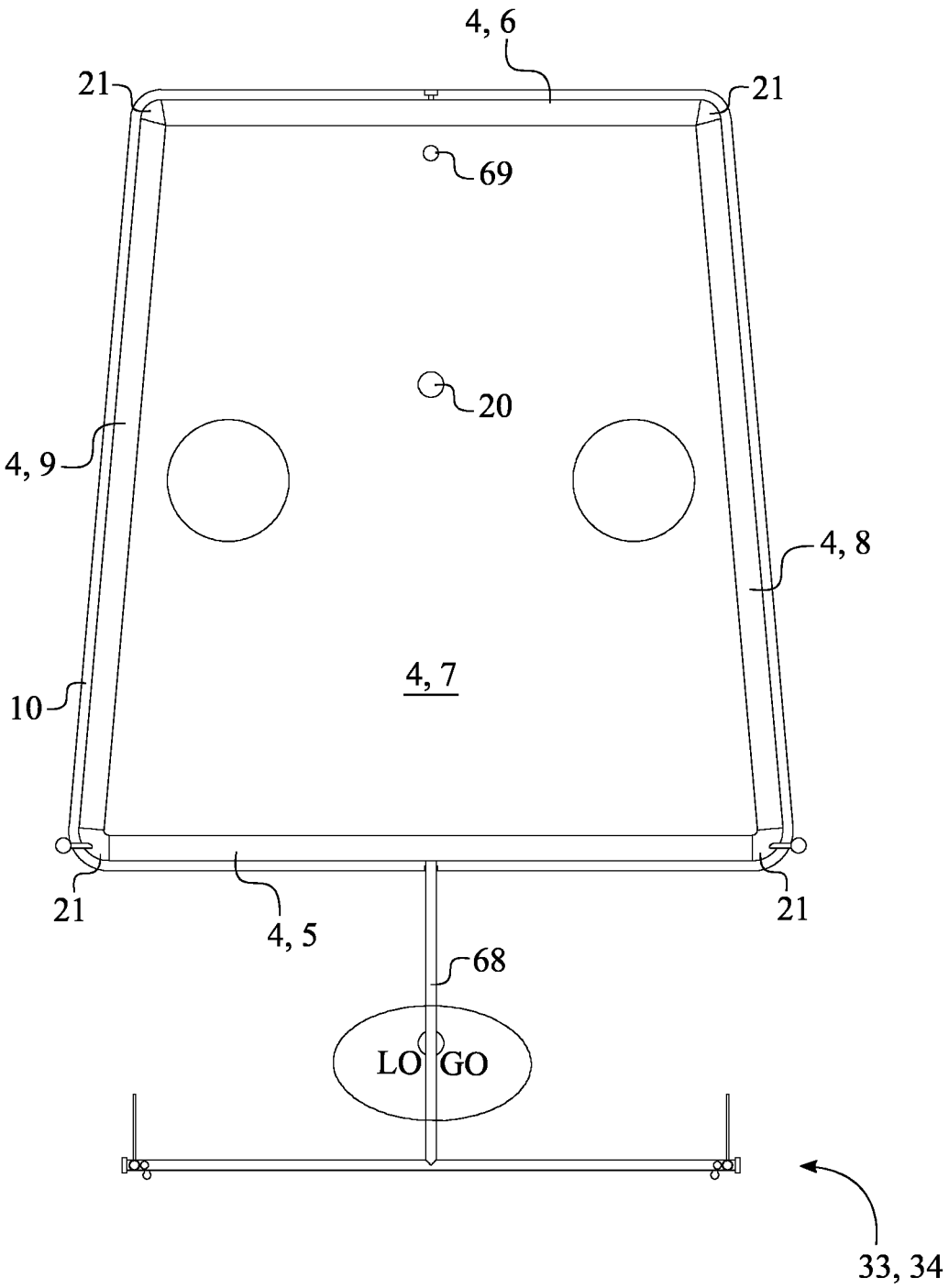
FIG. 3 is a top view of the present invention showing the foldable goal post.
Figure 4:
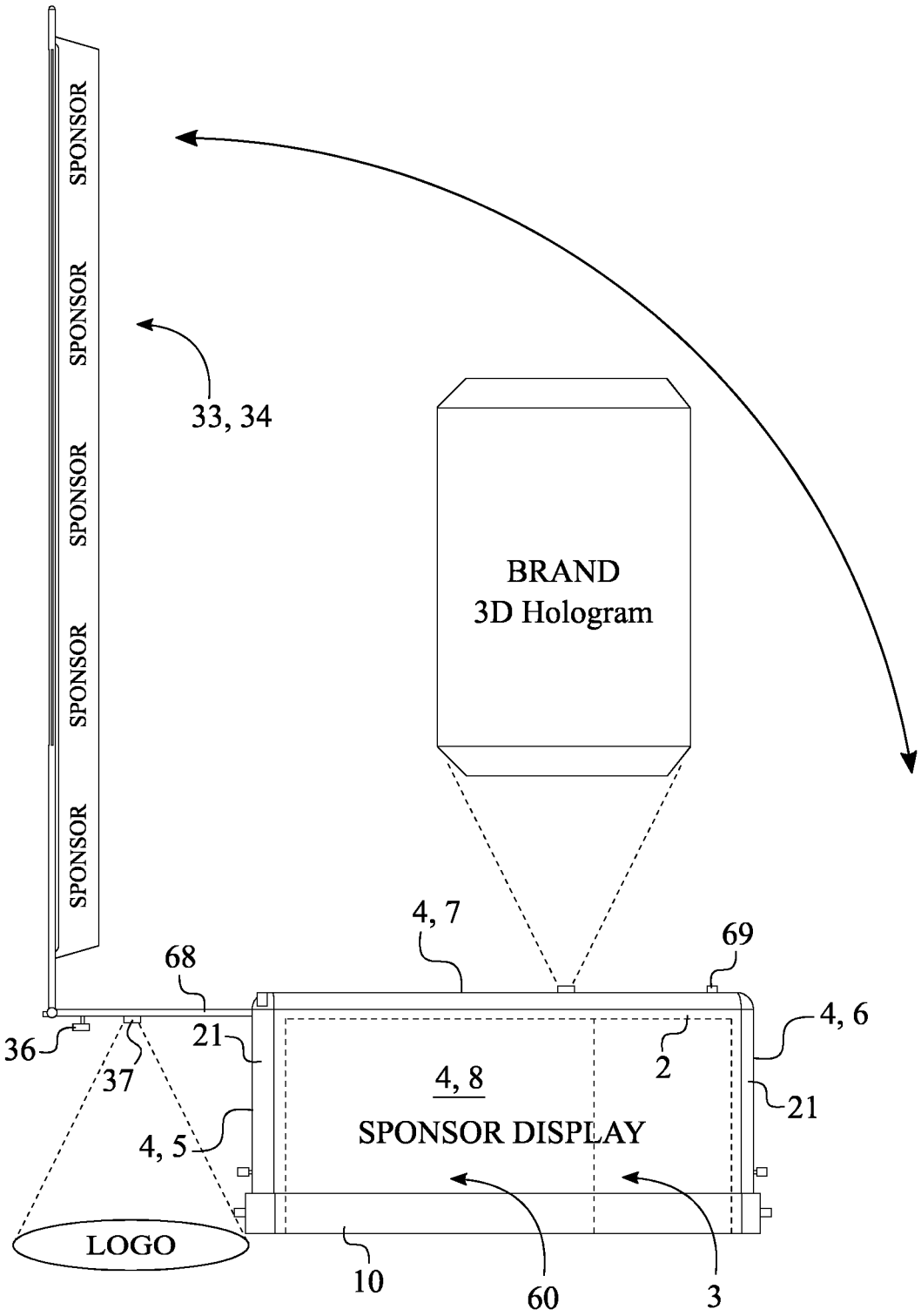
FIG. 4 is a side view of the present invention showing the foldable goal post.

All illustrations of the drawings are for the purpose of describing selected versions of the present invention and are not intended to limit the scope of the present invention.

The present invention is a freestanding structural display apparatus for sport goalposts that enables the users to play multiple games and events. Furthermore, the present invention increases the quality of the game and the health of the players and provides additional display panels for advertising and enhanced gaming/event experience. As shown in FIGS. 1-13, the present invention comprises an advertising displaying freestanding media structure 1, a main computing device 32, and a sporting game-scoring structure 33. The advertising displaying freestanding media structure 1 comprises a frame 2, a control room 3, a plurality of electronic screen display panels 4, a lower perimeter signage display ring 10, and a plurality of output panels 21.

In reference to the general configuration of the present invention, as shown in FIGS. 1-13 and FIG. 30, the frame 2 that functions as the structural skeleton is fully enclosed by the plurality of electronic screen display panels 4 and the plurality of output panels 21 so that the advertising displaying freestanding media structure 1 can function as an enclosed body. The lower perimeter signage display ring 10 is laterally connected around the frame 2 at the ground level to display advertisements and event/game information. The control room 3 is internally connected to the frame 2 thus providing a designated area for the operators of the present invention. The main computing device 32 that governs the operation of any electronic components of the present invention is positioned within the control room 3. The sporting game-scoring structure 33 is connected to the frame 2 and positioned atop a top panel 7 of the plurality of electronic screen display panels 4 so that the players can take part in the game being played.

In reference to FIG. 4, FIG. 7, FIG. 10, and FIG. 13, the frame 2 is a skeletal structural that enables the rest of the components of the present invention to be mounted. The frame 2 is preferably formed into a trapezoidal shape so that the plurality of electronic screen display panels 4 can be efficiently mounted. However, the frame 2 can be formed into any geometric shapes (circler, triangular, quadrilateral, polygon) without deviating the functionality of the present invention.

Depending upon different embodiments of the present invention, each of the plurality of electronic screen display panels 4 can be a digital panel or a non-digital panel, wherein the digital panel can be a transparent a light-emitting diode (LED) panel or an opaque LED panel. Furthermore, when each of the plurality of electronic screen display panels 4 is a digital panel, the plurality of electronic screen display panels 4 is electrically connected to the main computing device 32 so that the operators can control the plurality of electronic screen display panels 4. When each of the plurality of electronic screen display panels 4 is a non-digital panel, the plurality of electronic screen display panels 4 displays printed advertisements and does not have to be electrically connected to the main computing device 32. In reference to FIG. 14, FIG. 15, FIG. 19, and FIG. 20, the plurality of electronic screen display panels 4 may comprise a front panel 5, a rear panel 6, the top panel 7, a left panel 8, and a right panel 9. More specifically, the frame 2 is laterally enclosed by the front panel 5, the rear panel 6, the left panel 8, the right panel 9, and the plurality of output panels 21 thus covering the lateral sides of the frame 2. The lower perimeter signage display ring 10 and the top panel 7 are oppositely position of each other about the frame 2 so that the top panel 7 can be connected onto the top side of the frame 2. In other words, the top panel 7 is positioned within the front panel 5, the rear panel 6, the left panel 8, and the right panel 9 to fully enclosed the frame 2. Furthermore, the front panel 5 and the rear panel 6 are preferably made of flexible paneling materials, mesh type materials, or padding materials, or any other type of impact absorbing materials to minimize impact injuries of the players during the game. Furthermore, the plurality of electronic screen display panels 4 is an electronic display that is used to display visual content such as text, video, or image as the display technology is the most efficient way to communicate information during live sporting events. The plurality of electronic screen display panels 4 can include television sets, computer monitors, and digital advertising signage that is primarily used for branding awareness and sponsorship visibility for live audience and television viewers of a live broadcasting.

In reference to FIGS. 1-13 and FIG. 30, the lower perimeter signage display ring 10 is laterally connected around the frame 2 as the lower perimeter signage display ring 10 is adjacently positioned to the front panel 5, the rear panel 6, the left panel 8, and the right panel 9. More specifically, the lower perimeter signage display ring 10 can be utilized to display game-score, possession of the ball, player statistics, advertisements, weather conditions, any other types of digital images. The lower perimeter signage display ring 10 is electrically connected to the main computing device 32 so that the operators can efficiently operate the lower perimeter signage display ring 10 within the control room 3.

The plurality of output panels 21 provides the audible effects and/or video effects for the present invention so that the ordinance can fully experience the game/event being played in relation to the advertising displaying freestanding media structure 1. In reference to FIG. 14, FIG. 15, FIG. 19, FIG. 20, and FIG. 30, the plurality of output panels 21 may comprise a front-left panel 22, a front-right panel 23, a rear-left panel 24, and a rear-right panel 25. Each of the plurality of output panels 21 function as an intermediate body between a pair of display panels from the plurality of electronic screen display panels 4. More specifically, the front-left panel 22 is mounted in between the front panel 5 and the left panel 8. The front-right panel 23 is mounted in between the front panel 5 and the right panel 9. The rear-left panel 24 is mounted in between the rear panel 6 and the left panel 8. The rear-right panel 25 is mounted in between the rear panel 6 and the right panel 9. As a result, the plurality of output panels 21 is able to radially distribute audible outputs and/or video outputs from the advertising displaying freestanding media structure 1. The plurality of output panels 21 is electrically connected to the main computing device 32 so that operators can operate the plurality of output panels 21 within the control room 3. The plurality of output panels 21 may be used for a variety of purposes including, but not limited to, score announcement, advertisement audio, music, advertisement display, game statistic, and other similar types of outputs. It is preferred that each of plurality of output panels 21 is oriented outward from the advertising displaying freestanding media structure 1 for maximum functionality, although alternative orientation may also be utilized.

In reference to FIGS. 14-17, FIG. 19, FIG. 20, and FIG. 30, the present invention may further comprise a first drone platform 11, a first lifting mechanism 12, a second drone platform 13, and a second lifting mechanism 14. The first drone platform 11 and the second drone platform 13 are integrated into the top panel 7 to take off and land a pair of drones. More specifically, the first drone platform 11 is adjacently positioned to the left panel 8. The second drone platform 13 is adjacently positioned to the right panel 9. The first drone platform 11 is operatively coupled to the frame 2 by the first lifting mechanism 12, wherein the first lifting mechanism 12 vertically moves the first drone platform 11 in and out of the control room 3. Similarly, the second drone platform 13 is operatively coupled to the frame 2 by the second lifting mechanism 14, wherein the second lifting mechanism 14 vertically moves the second drone platform 13 in and out of the control room 3. The first lifting mechanism 12 is electrically connected to the main computing device 32 so that the operators can individually move the first drone platform 11 in and out of the control room 3 via the main computing device 32. The second lifting mechanism 14 is electrically connected to the main computing device 32 so that the operators can individually move the second drone platform 13 in and out of the control room 3 via the main computing device 32. The pair of drones are remotely controlled from the control room 3 and utilized within the present invention to project an image onto the field/ground for advertising purpose, broadcasting steaming, or implement any other standard drone features. For example, the pair of drones can be used to project a team logo or an advertising logo onto the field of play. The pair of drones can also be used to broadcast live production from above the field/ground of the live game play, capture live actions of the stadium, capture live actions of the audience, or any other live broadcasting to display through the plurality of electronic screen display panels 4.

Figure 14:
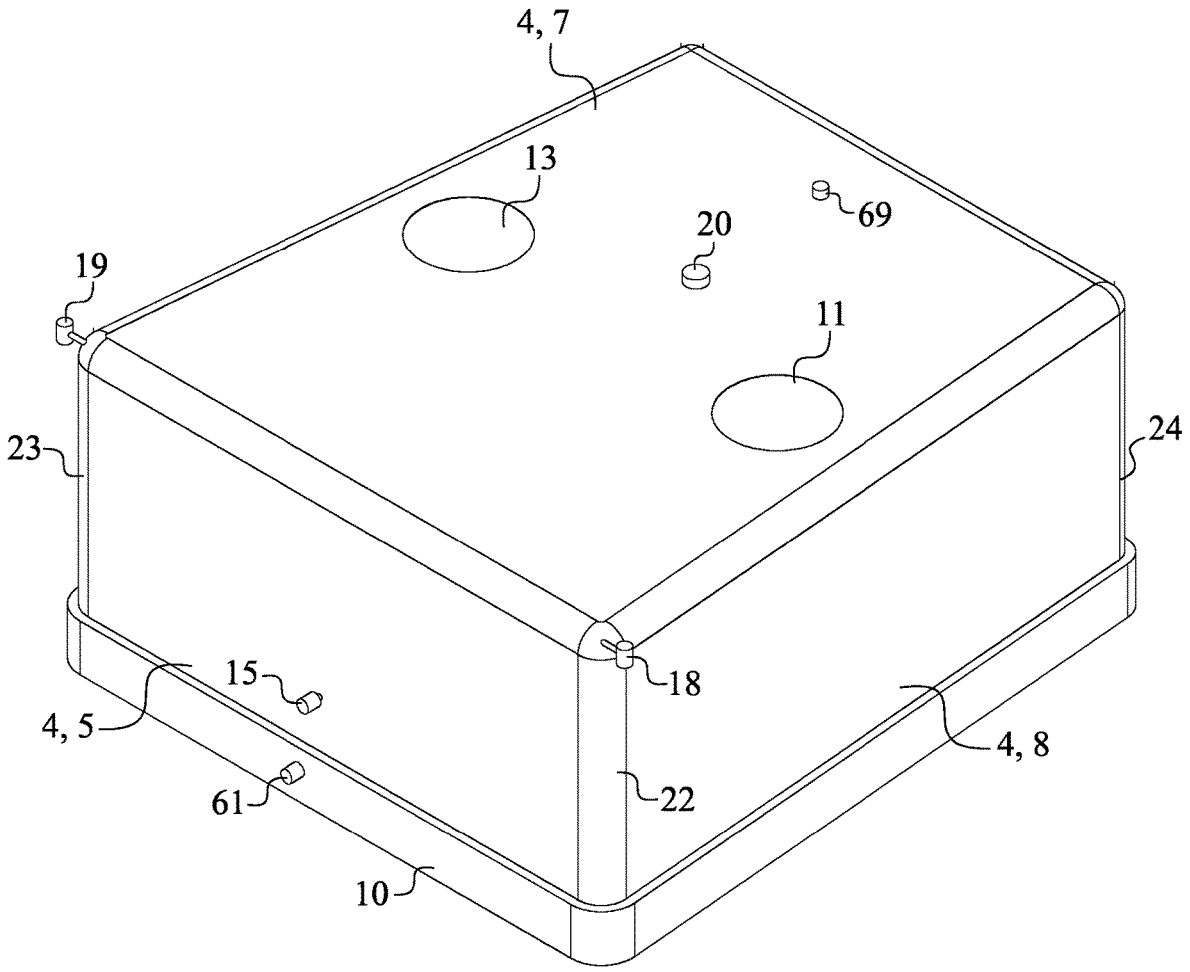
FIG. 14 is a front perspective view of the freestanding media structure of the present invention.
Figure 15:
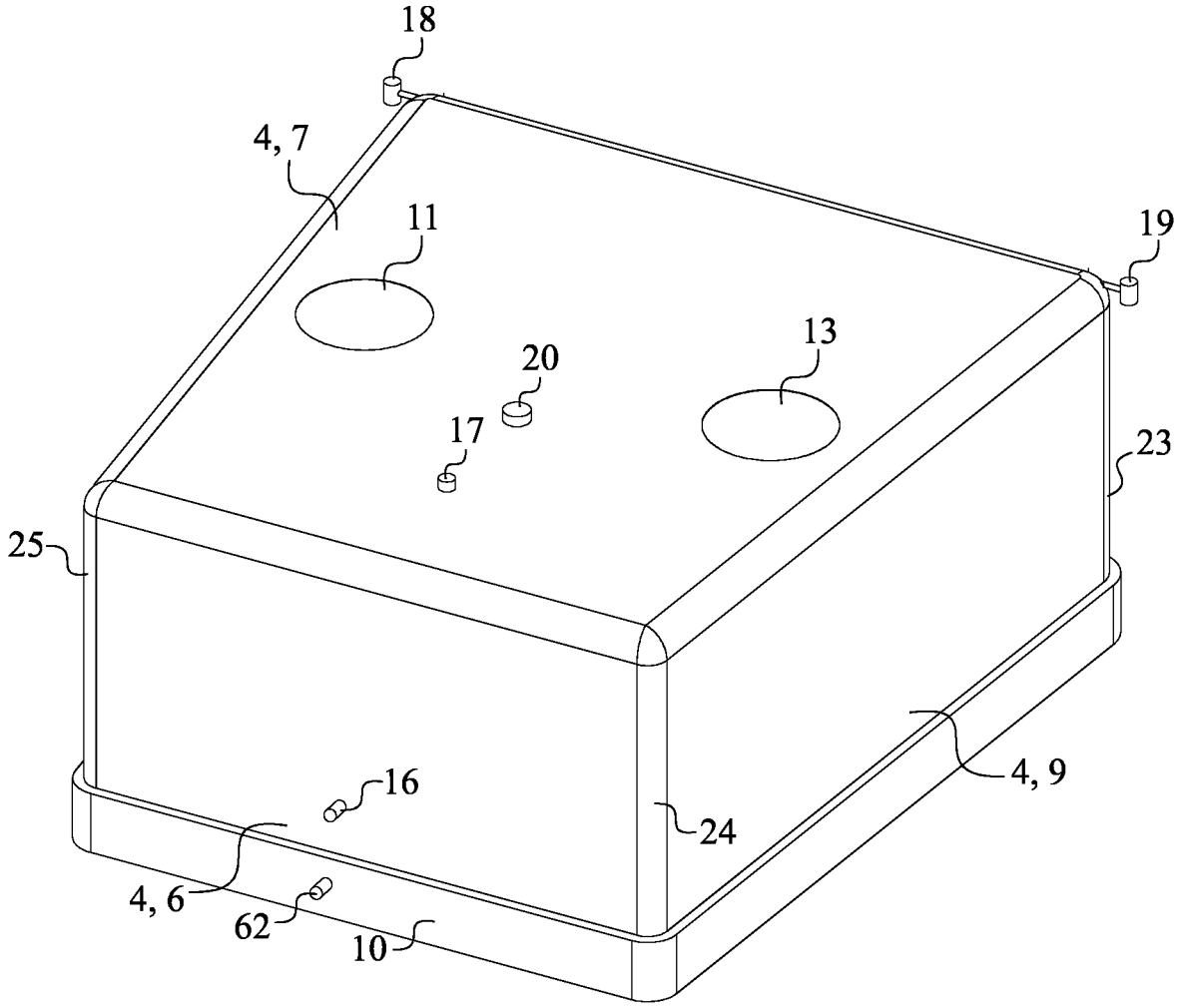
FIG. 15 is a rear perspective view of the freestanding media structure of the present invention.
Figure 16:
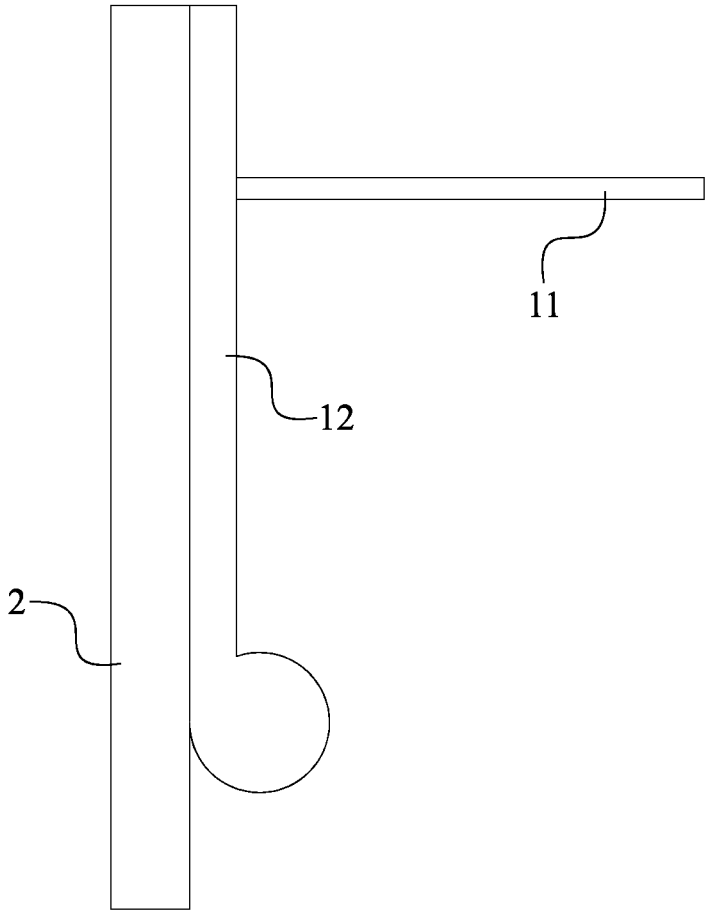
FIG. 16 is a schematic view showing the first lifting mechanism of the present invention.
Figure 17:
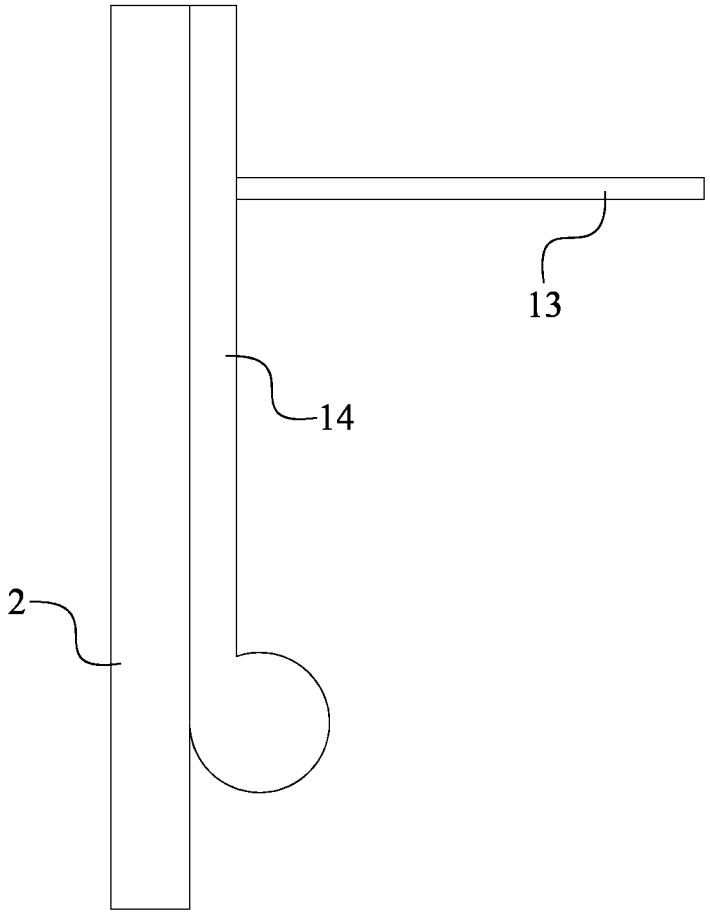
FIG. 17 is a schematic view showing the second lifting mechanism of the present invention.
Figure 19:
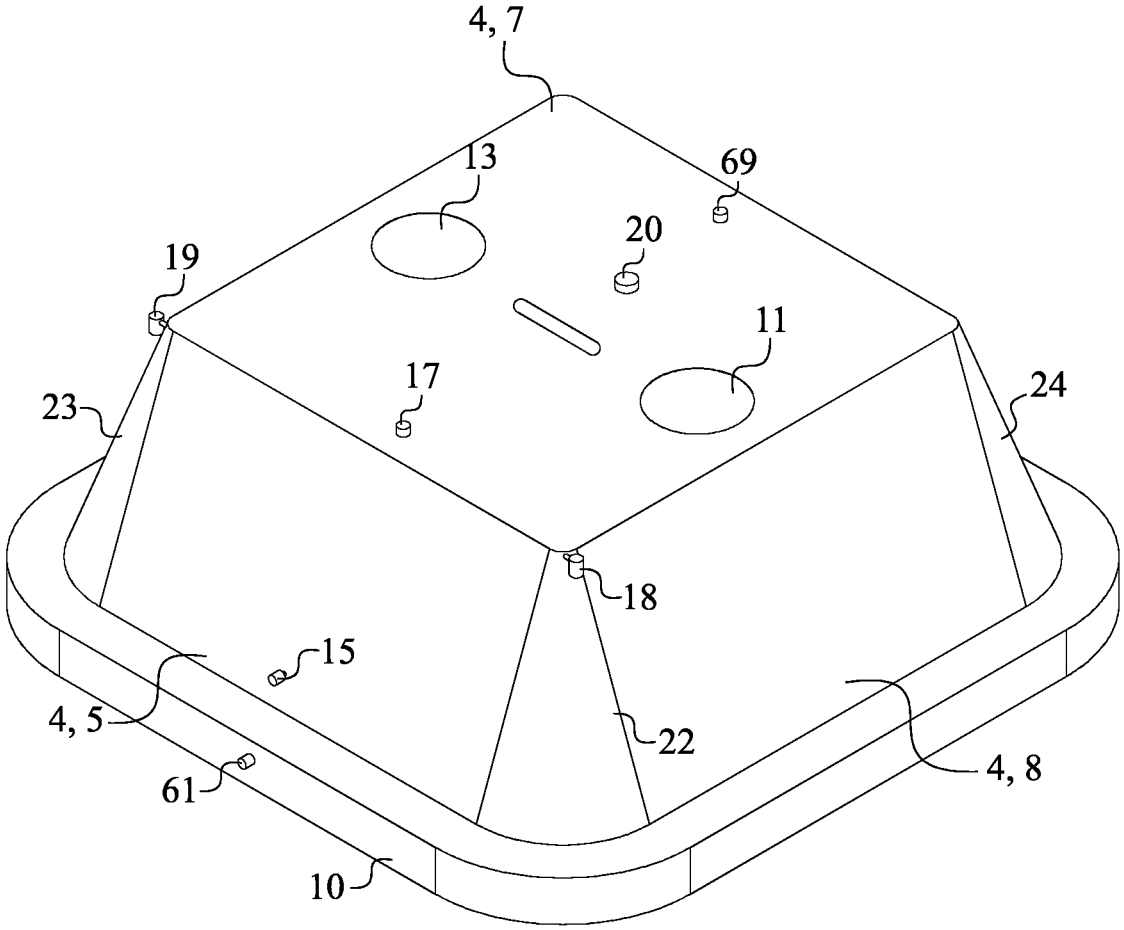
FIG. 19 is a front perspective view of the freestanding media structure of the present invention.
Figure 20:
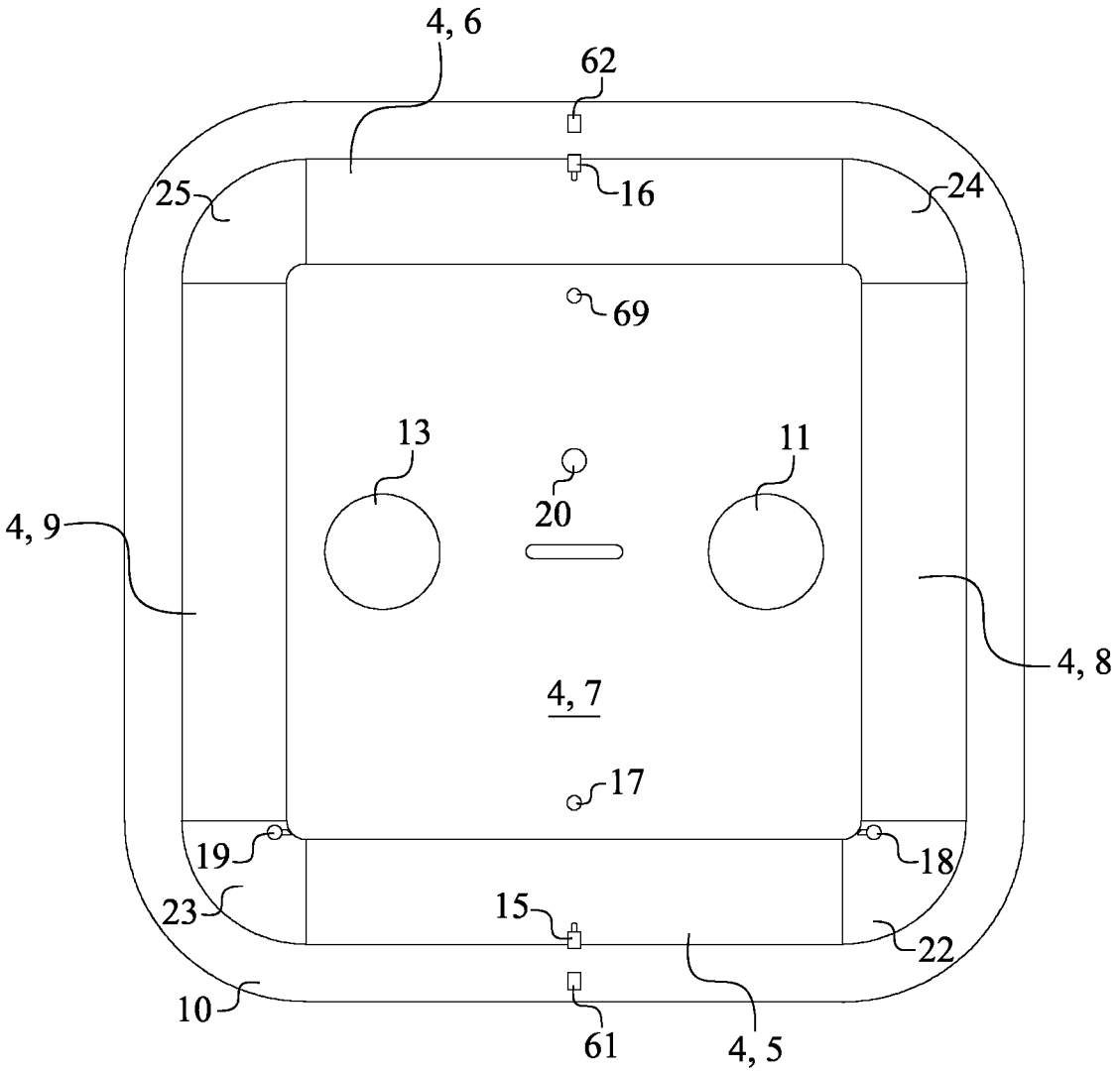
FIG. 20 is a top view of the freestanding media structure of the present invention.
Figure 21:
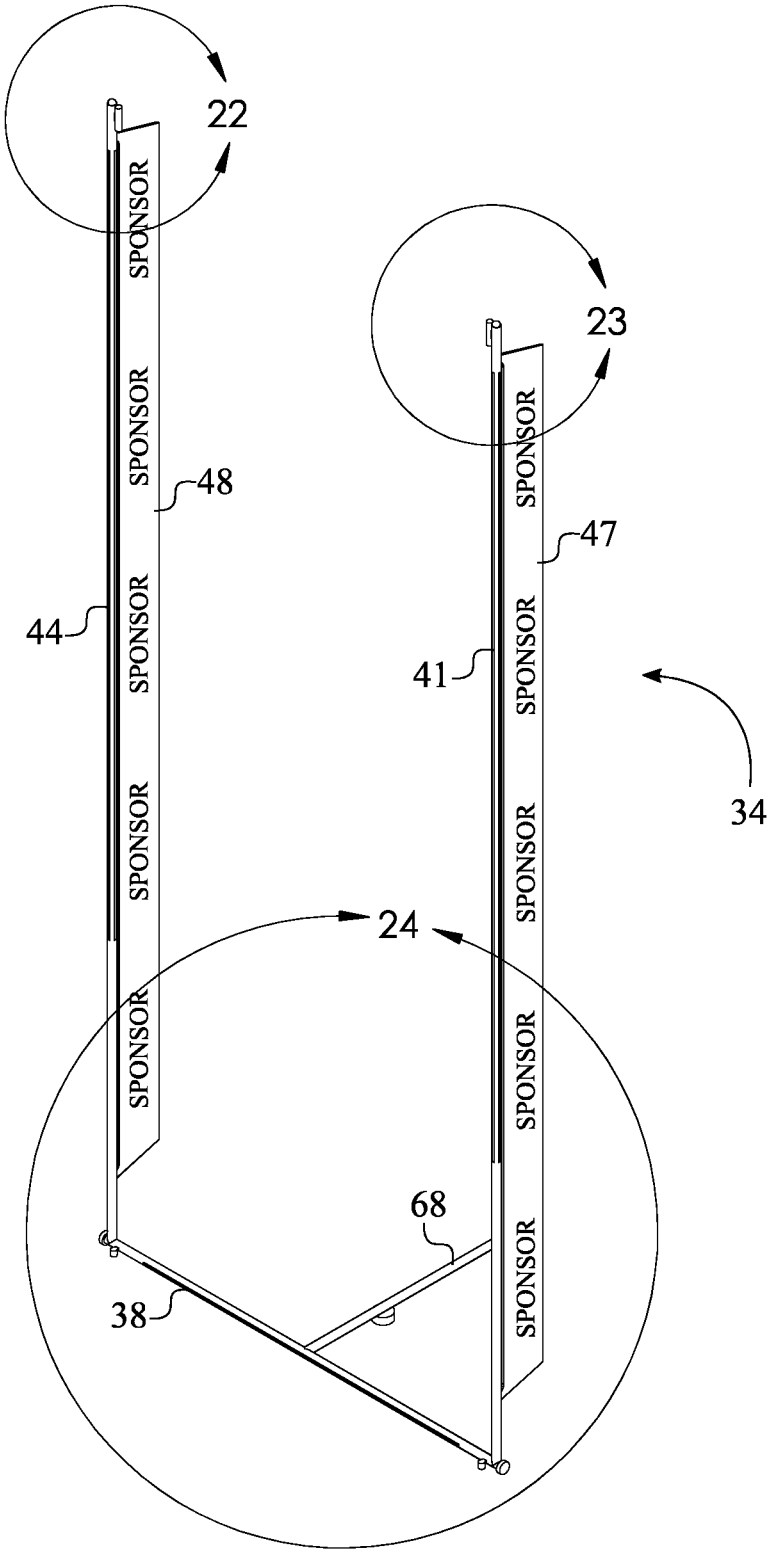
FIG. 21 is a front perspective view of the foldable goal post of the present invention.
Figure 30:
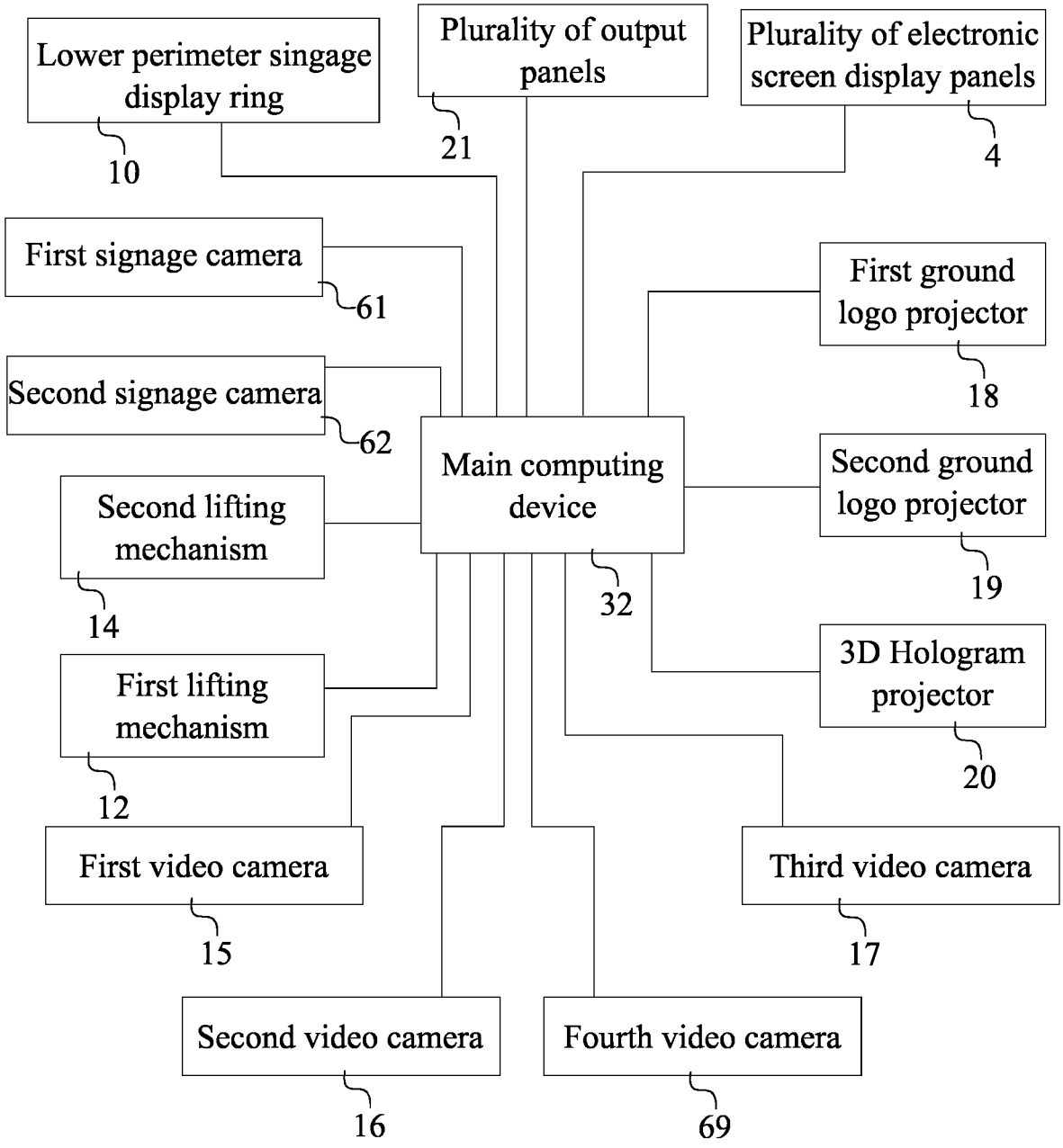
FIG. 30 is a schematic view showing the electrical connections between the main computing device and the freestanding media structure.

In reference to FIG. 14, FIG. 19, and FIG. 30, the present invention may further comprise a first video camera 15 and a second video camera 16. The first video camera 15 and the second video camera 16 are utilized to stream and broadcast game/event with respect to the positioning of the advertising displaying freestanding media structure 1. The first video camera 15 is mounted to the frame 2 in such a way that the first video camera 15 is positioned adjacent to the front panel 5 and oriented outward from the front panel 5. As a result, the first video camera 15 is able to fully capture a front field of view of the advertising displaying freestanding media structure 1. Preferably, the first video camera 15 is positioned adjacent to the lower perimeter signage display ring 10; however, the first video camera 15 is not limited to the aforementioned positioning and can be positioned anywhere within the front panel 5. The second video camera 16 is mounted to the frame 2 in such a way that the second video camera 16 is positioned adjacent to the rear panel 6 and oriented outward from the rear panel 6. As a result, the second video camera 16 is able to fully capture a rear field of view of the advertising displaying freestanding media structure 1. Preferably, the second video camera 16 is positioned adjacent to the lower perimeter signage display ring 10; however, second video camera 16 is not limited to the aforementioned positioning and can be positioned anywhere within the rear panel 6. The first video camera 15 and the second video camera 16 are electrically connected to the main computing device 32 so that the operators rotate, move, zoom in, and zoom out the first video camera 15 and the second video camera 16 according to the streaming/broadcasting preferences and game/event changes.

In reference to FIG. 14, FIG. 19, and FIG. 30, the present invention may further comprise a third video camera 17 and a fourth camera 69. The third video camera 17 is utilized to stream and broadcast game/event with respect to the positioning of the sporting game-scoring structure 33. The third video camera 17 is positioned adjacent to the front panel 5. The third video camera 17 is mounted onto the top panel 7 in such a way that the third video camera 17 is oriented toward the sporting game-scoring structure 33. As a result, the third video camera 17 is able to fully capture a sky view of the advertising displaying freestanding media structure 1 in between the front panel 5 and the sporting game-scoring structure 33. The fourth video camera 69 is also utilized to stream and broadcast game/event with respect to the positioning of the sporting game-scoring structure 33. The fourth video camera 69 is positioned adjacent to the rear panel 6. The fourth video camera 69 is mounted onto the top panel 7 in such a way that the fourth video camera 69 is oriented toward the sporting game-scoring structure 33. As a result, the fourth video camera 69 is able to fully capture a sky view of the advertising displaying freestanding media structure 1 in between the rear panel 6 and the sporting game-scoring structure 33. The third video camera 17 and the fourth video camera 69 are electrically connected to the main computing device 32 so that the operators rotate, move, zoom in, and zoom out the third video camera 17 according to the streaming/broadcasting preferences and game/event changes.

In reference to FIG. 14, FIG. 19, and FIG. 30, the present invention may further comprise a first signage camera 61 and a second signage camera 62. The first signage camera 61 and the second signage camera 62 are utilized to stream and broadcast game/event with respect to the positioning of the advertising displaying freestanding media structure 1. The first signage camera 61 is mounted to the lower perimeter signage display ring 10 in such a way that the first signage camera 61 is positioned adjacent to the front panel 5 and oriented outward from the front panel 5. As a result, the first signage camera 61 is able to fully capture a front field of view of the advertising displaying freestanding media structure 1. Preferably, the first signage camera 61 is centrally positioned on to the lower perimeter signage display ring 10; however, the first signage camera 61 is not limited to the aforementioned positioning and can be positioned anywhere within the lower perimeter signage display ring 10. The second signage camera 62 is mounted to the lower perimeter signage display ring 10 in such a way that the second signage camera 62 is positioned adjacent to the rear panel 6 and oriented outward from the rear panel 6. As a result, the second signage camera 62 is able to fully capture a rear field of view of the advertising displaying freestanding media structure 1. Preferably, the second signage camera 62 is centrally positioned on the lower perimeter signage display ring 10; however, second signage camera 62 is not limited to the aforementioned positioning and can be positioned anywhere within the lower perimeter signage display ring 10. The first signage camera 61 and the second signage camera 62 are electrically connected to the main computing device 32 so that the operators rotate, move, zoom in, and zoom out the first signage camera 61 and the second signage camera 62 according to the streaming/broadcasting preferences and game/event changes.

In reference to FIG. 14, FIG. 19, and FIG. 30, the present invention may further comprise a first ground logo projector 18 and a second ground logo projector 19. The first ground logo projector 18 and the second ground logo projector 19 are utilized to project an image with respect to the positioning of the advertising displaying freestanding media structure 1. More specifically, the first ground logo projector 18 is mounted to the frame 2 in such a way that the first ground logo projector 18 is positioned adjacent to the top panel 7, the front panel 5, and the left panel 8. In other words, the first ground logo projector 18 is mounted about the adjacent corners of the top panel 7, the front panel 5, and the left panel 8 so that the first ground logo projector 18 is able to project an image an image onto the field/ground for advertising purpose. For example, the first ground logo projector 18 can project a team logo onto the field of play. Similarly, the second ground logo projector 19 is mounted to the frame 2 in such a way that the second ground logo projector 19 is positioned adjacent to the top panel 7, the front panel 5, and the right panel 9. In other words, the second ground logo projector 19 is mounted about the adjacent corners of the top panel 7, the front panel 5, and the right panel 9 so that the second ground logo projector 19 is able to project an image an image onto the field/ground for advertising purpose. For example, the first ground logo projector 18 can project an advertising logo onto the field of play. The first ground logo projector 18 and the second ground logo projector 19 are electrically connected to the main computing device 32 so that the operators can project the corresponding images to the field/ground.

In reference to FIG. 14, FIG. 19, and FIG. 30, the present invention may further comprise a 3D hologram projector 20 that is mounted onto the top panel 7. The 3D hologram projector 20 is electrically connected to the main computing device 32 so that the operator can operate the hologram project within the control room 3. More specifically, the 3D hologram projector 20 displays content directly above the advertising displaying freestanding media structure 1. The 3D hologram projector 20 is preferably a multidirectional system capable of rotating and tilting in order to display a three-dimension hologram anywhere around the advertising displaying freestanding media structure 1. The 3D hologram projector 20 may be oriented towards the sky, above the field, and above the stadium goal frame 2, in particular towards the top center of the sport stadium field to project large three-dimensional images floating in mid-air to be seen from any angle and from under or above the present invention during live game/event. The 3D hologram projector 20 may display information including, but is not limited to, sponsor logo, company products, replays of the most recent goal, three dimensional images of sports team and player t-shirt, jersey or sports team logo associated with the most recent scored goal, advertisements, and other similar content.

Figure 18:
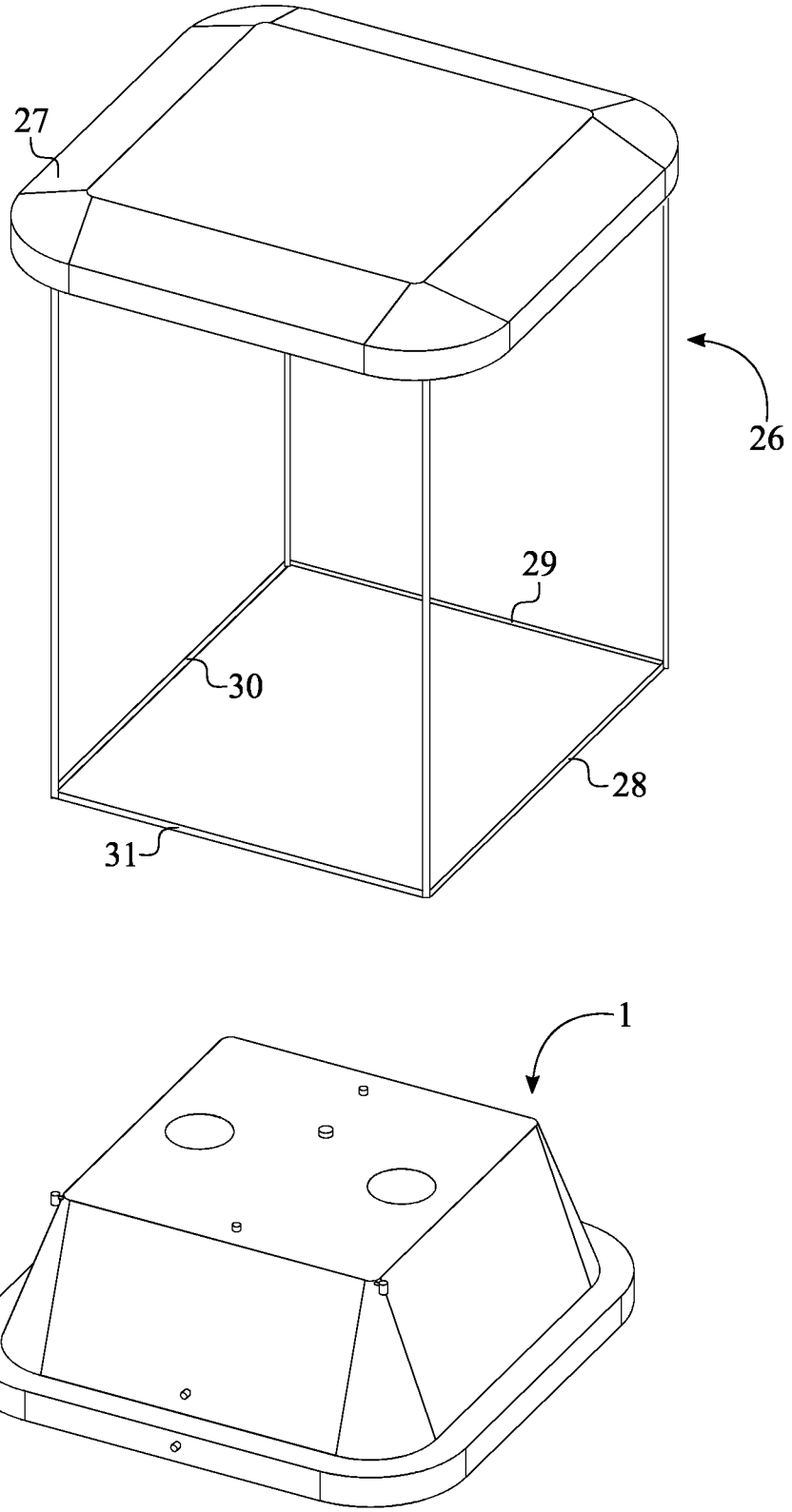
FIG. 18 is a perspective view of the retractable display system of the present invention.
Figure 31:
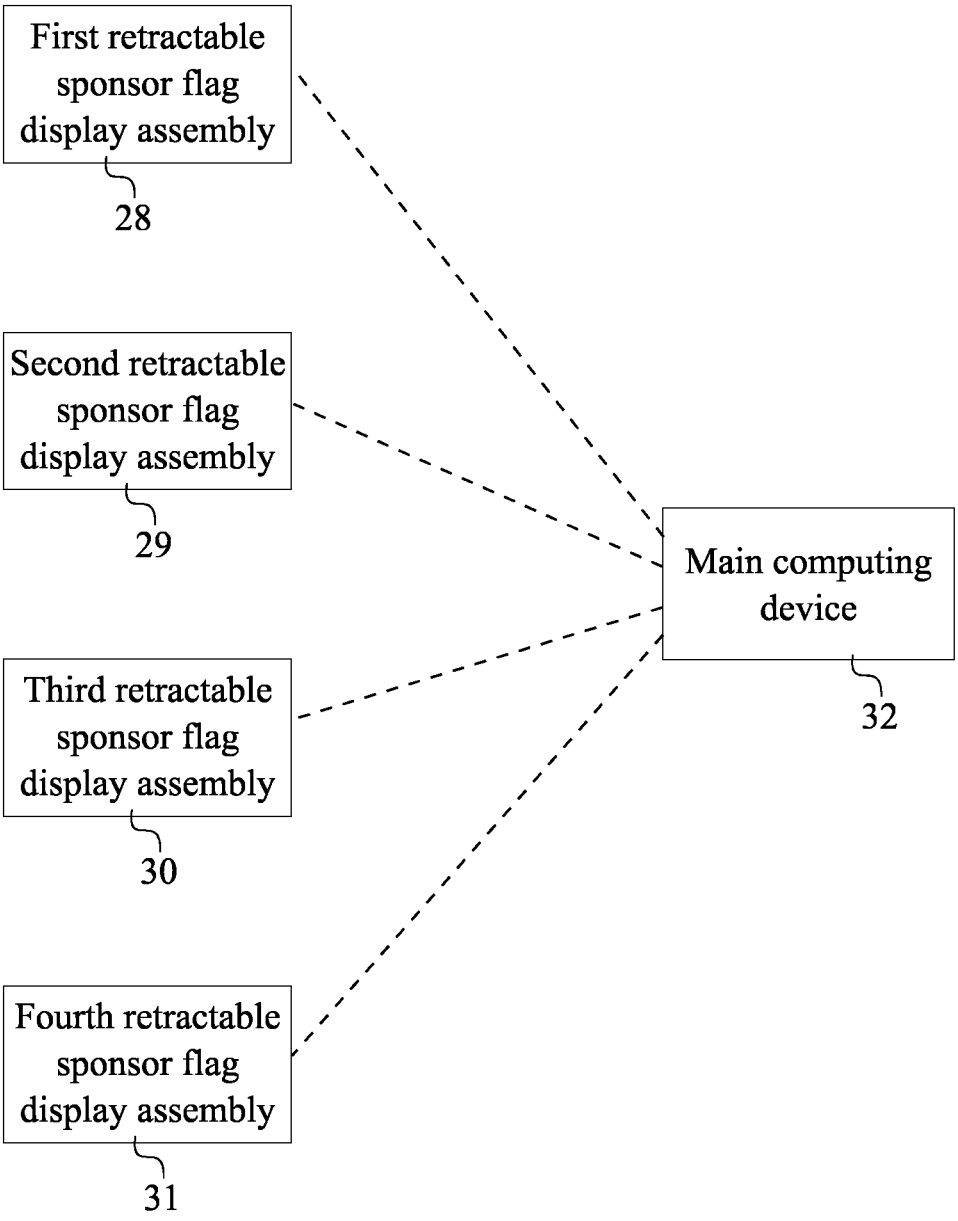
FIG. 31 is a schematic view showing the electrical connections between the main computing device and the retractable display system.

In reference to FIG. 18 and FIG. 31, the present invention may further comprise a retractable display system 26. The retractable display system 26 utilizes a plurality of flags to laterally covers the sporting game-scoring structure 33 that is connected to the frame 2. More specifically, the retractable display system 26 may comprise a suspended structure 27, a first retractable sponsor flag display assembly 28, a second retractable sponsor flag display assembly 29, a third retractable sponsor flag display assembly 30, and a fourth retractable sponsor flag display assembly 31. The suspended structure 27 is mounted atop the advertising displaying freestanding media structure 1, preferably a suspended digital score board, wherein the suspended structure 27 is linearly offset from the advertising displaying freestanding media structure 1. The first retractable sponsor flag display assembly 28, the second retractable sponsor flag display assembly 29, the third retractable sponsor flag display assembly 30, and the fourth retractable sponsor flag display assembly 31 are perimetrically mounted around the suspended structure 27 so that the plurality of flags can be mounted to the suspended structure 27. The first retractable sponsor flag display assembly 28, the second retractable sponsor flag display assembly 29, the third retractable sponsor flag display assembly 30, and the fourth retractable sponsor flag display assembly 31 are communicably coupled to the main computing device 32 thus allowing the operators to vertically move up and down the first retractable sponsor flag display assembly 28, the second retractable sponsor flag display assembly 29, the third retractable sponsor flag display assembly 30, and the fourth retractable sponsor flag display assembly 31. For example, when the plurality of flags has to be displayed, the first retractable sponsor flag display assembly 28, the second retractable sponsor flag display assembly 29, the third retractable sponsor flag display assembly 30, and the fourth retractable sponsor flag display assembly 31 move downward until terminal ends of each assembly contact the advertising displaying freestanding media structure 1. When the plurality of flags has to folded, the first retractable sponsor flag display assembly 28, the second retractable sponsor flag display assembly 29, the third retractable sponsor flag display assembly 30, and the fourth retractable sponsor flag display assembly 31 move upward until the terminal ends of each assembly contact the suspended structure 27.

As shown in FIG. 1, the present invention may further comprise a hospitality suite 60 that is internally connected to the frame 2. The hospitality suite is an enclosed deluxe hospitality room; which consist of individual private and club seating is an exclusive class of seating within the advertising displaying freestanding media structure 1 and located directly and anywhere on the grounds of any pitches of all sports venues and sports facilities, which provide closer access to the game offering the best view of the event. Furthermore, the advertising displaying freestanding media structure 1 can comprise integrated doors to access the control room 3, integrated windows to provide visual access, a plurality of wheels to move the frame 2, and any other structural and functional features that are standard within the industry.

In reference to FIGS. 21-24, in some embodiment of the present invention, the sporting game-scoring structure 33 comprises a foldable reclining upright post 34 that is similar to American football goal post. The foldable reclining upright post 34 is electrically connected to the main computing device 32 so that the operators can control specific feature of the foldable reclining upright post 34. As shown in FIGS. 21-24 and FIG. 32, the foldable reclining upright post 34 may comprise an illuminated light strobe cross bar 38, an illuminated light strobe left pole 41, and an illuminated light strobe right pole 44. The illuminated light strobe cross bar 38 is mounted to the frame 2 in such a way that the illuminated light strobe cross bar 38 is linearly extended from the left panel 8 to the right panel 9. The illuminated light strobe left pole 41 and the illuminated light strobe right pole 44 are positioned parallel to each other about the illuminated light strobe cross bar 38. Resultantly, the illuminated light strobe left pole 41 is terminally connected to the illuminated light strobe cross bar 38 at a right angle as the illuminated light strobe left pole 41 is adjacently positioned to the left panel 8 and perpendicularly positioned to the top panel 7. Similarly, the illuminated light strobe right pole 44 is terminally connected to the illuminated light strobe cross bar 38 at a right angle as the illuminated light strobe right pole 44 is adjacently positioned to the right panel 9 and perpendicularly positioned to the top panel 7. The illuminated light strobe cross bar 38, the illuminated light strobe left pole 41, and the illuminated light strobe right pole 44 are electrically connected to the main computing device 32 so that the foldable reclining upright post 34 can be lighted according to game/event outcomes. For example, the illuminated light strobe cross bar 38, the illuminated light strobe left pole 41, and the illuminated light strobe right pole 44 can be activated via the main computing device 32 when each time a goal is scored, at the beginning of the game, and at the end of the game. It is preferred that the illuminated light strobe cross bar 38, the illuminated light strobe left pole 41, and the illuminated light strobe right pole 44 are linearly integrated with a plurality of waterproof stadium LED rows for maximum illumination In reference to a first embodiments of the foldable reclining upright post 34, the foldable reclining upright post 34 further comprises a telescopic support arm 68, at least one field projector 37, and at least one field camera 36. The telescopic support arm 68 is retractably mounted to the frame 2 as shown in FIGS. 1-4. More specifically, the telescopic support arm 68 functions as a mounting member of the foldable reclining upright post 34 so that the illuminated light strobe cross bar 38 can be retractably mounted to the frame 2 by the telescopic support arm 68. The telescopic support arm 68 is symmetrically positioned in between the left panel 8 and the right panel 9 and outwardly extended from the front panel 5. As a result, the illuminated light strobe cross bar 38 can move toward the front panel 5 or move away from the front panel 5. Preferably, the retractable movement of the foldable reclining upright post 34 is operated through the main computing device 32 as the telescopic support arm 68 is electrically connected to the main computing device 32. Furthermore, the at least one field projector 37 that can project an image of brand logo onto the field/ground is mounted to the telescopic support arm 68. Furthermore, the at least one field logo projector 37 can be mounted to the American Football gooseneck support post, the basketball backboard arm support and electrically connected to the main computing device 32 so that the projected image of brand logos can be visible underneath the illuminated light strobe cross bar 38 or the telescopic support arm 68. Furthermore, the at least one field logo projector 37 can be mounted anywhere on any goal post frame such as the traditional American football frame and support post for the crossbar, soccer goal post frame and its net posts soccer and rear frame, futsal goal post, rugby goal post, basketball backboard arm support including and any freestanding goal post frame positioned and mounted on all pitches, with the pitch logo projector is primarily used by professional sports leagues, and organizations. At least on-pitch logo projector technology is designed to project the visual image sponsor's logo to the surface of the pitch, specifically anywhere around and within the goal post frame and design of the goal net to maximize brand visibility at live sporting events. The at least one field logo projector 37 can project the sponsor logo directly or indirectly behind the baseline mark, end line mark and goal line mark mainly used in live sporting events. The first embodiments of the foldable reclining upright post 34 is utilized within existing rules of the football game, the rugby game, or any other games that require similar goalpost. The at least one field camera 36 is mounted to the telescopic support arm 68 and electrically connected to the main computing device 32. The field camera 36 is oriented towards the field/ground and outward from the front panel 5 for stream and broadcast purpose wherein the exact positioning of the field camera 36 is able to provide an additional camera angle in addition to the first video camera 15. The telescopic support arm 68 also enables the foldable reclining upright post 34 to be move between a folded position and an unfolded position via a folding recliner mechanism. When the foldable reclining upright post 34 is in a folded position, the illuminated light strobe left pole 41 and the illuminated light strobe right pole 44 are positioned parallel to the top panel 7. When the foldable reclining upright post 34 is in the unfolded position, the illuminated light strobe left pole 41 and the illuminated light strobe right pole 44 are positioned perpendicular to the top panel 7. Furthermore, the first embodiments of the foldable reclining upright post 34 only utilizes the fourth camera 69 within the advertising displaying freestanding media structure 1 as the foldable reclining upright post 34 is positioned offset from the front panel 5.

In reference to a second embodiments of the foldable reclining upright post 34, the foldable reclining upright post 34 further comprises a support post 35 that is mounted to the frame 2 as shown in FIGS. 8-10 and FIG. 28. The support post 35 is adjacently positioned on the top panel 7 and outwardly extended from the top panel 7 so that the illuminated light strobe cross bar 38 can be mounted to the frame 2 by the support post 35. Resultantly, the illuminated light strobe cross bar 38, the illuminated light strobe left pole 41, and the illuminated light strobe right pole 44 are positioned within the lower perimeter signage display ring 10. The second embodiment of the foldable reclining upright post 34 can be utilized with a new type of game that may result in the present invention further comprising a first player platform 56 and a second player platform 57. More specifically, the advertising displaying freestanding media structure 1 is centrally positioned in between the first player platform 56 and the second player platform 57 as the sporting game-scoring structure 33 (the foldable reclining upright post 34) is adjacently positioned atop the top panel 7. The first player platform 56 is diametrically opposed of the second player platform 57 so that multiple players can stand on each of the platforms to execute the game of play. Furthermore, the second embodiments of the foldable reclining upright post 34 utilizes both the third video camera 17 and the fourth camera 69 within the advertising displaying freestanding media structure 1 as the foldable reclining upright post 34 is centrally positioned within the top panel 7.

Figure 22:
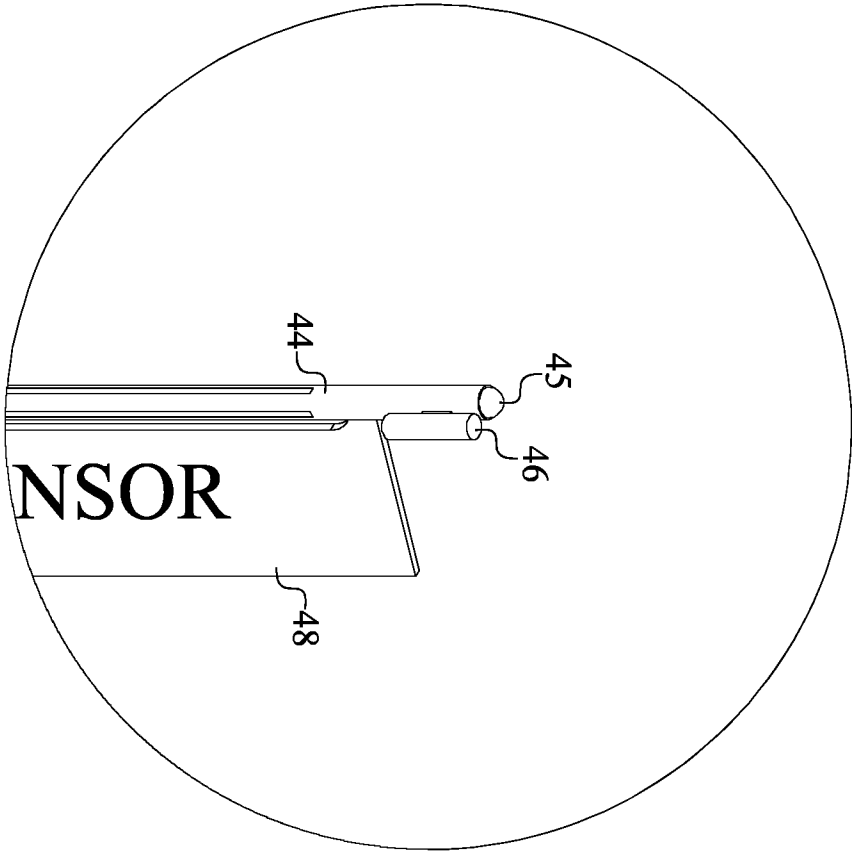
FIG. 22 is a detailed view showing illuminated right pole of the foldable goal post of the present invention.
Figure 23:
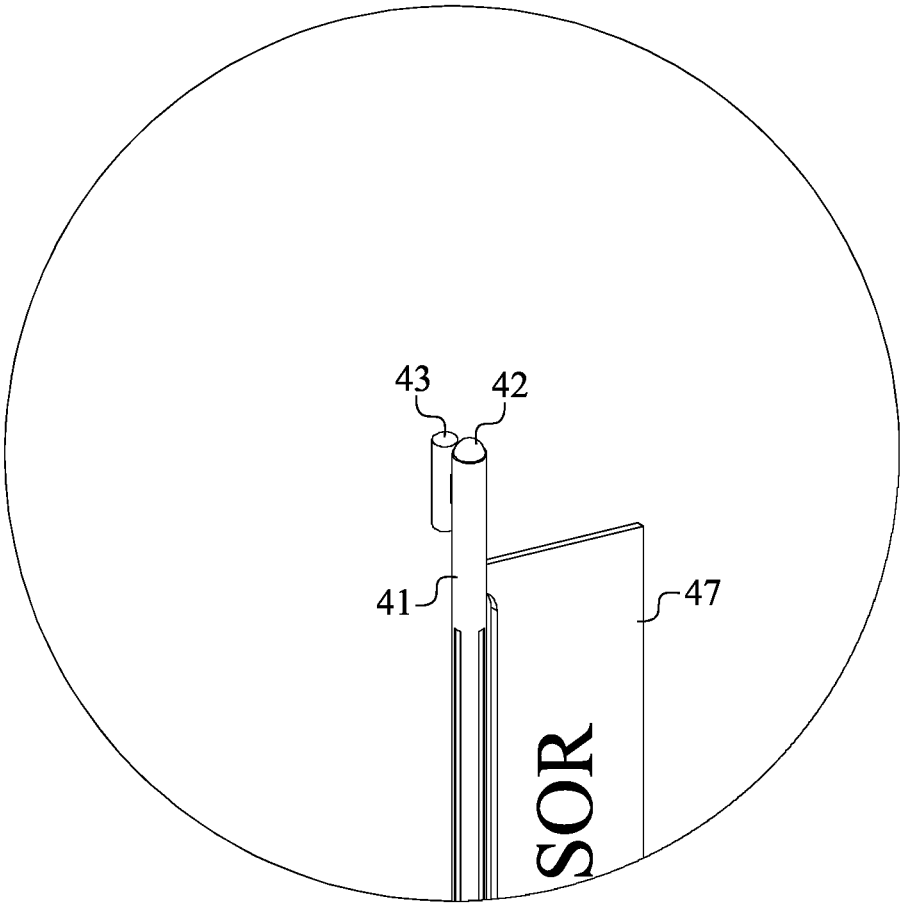
FIG. 23 is a detailed view showing illuminated left pole of the foldable goal post of the present invention.
Figure 32:
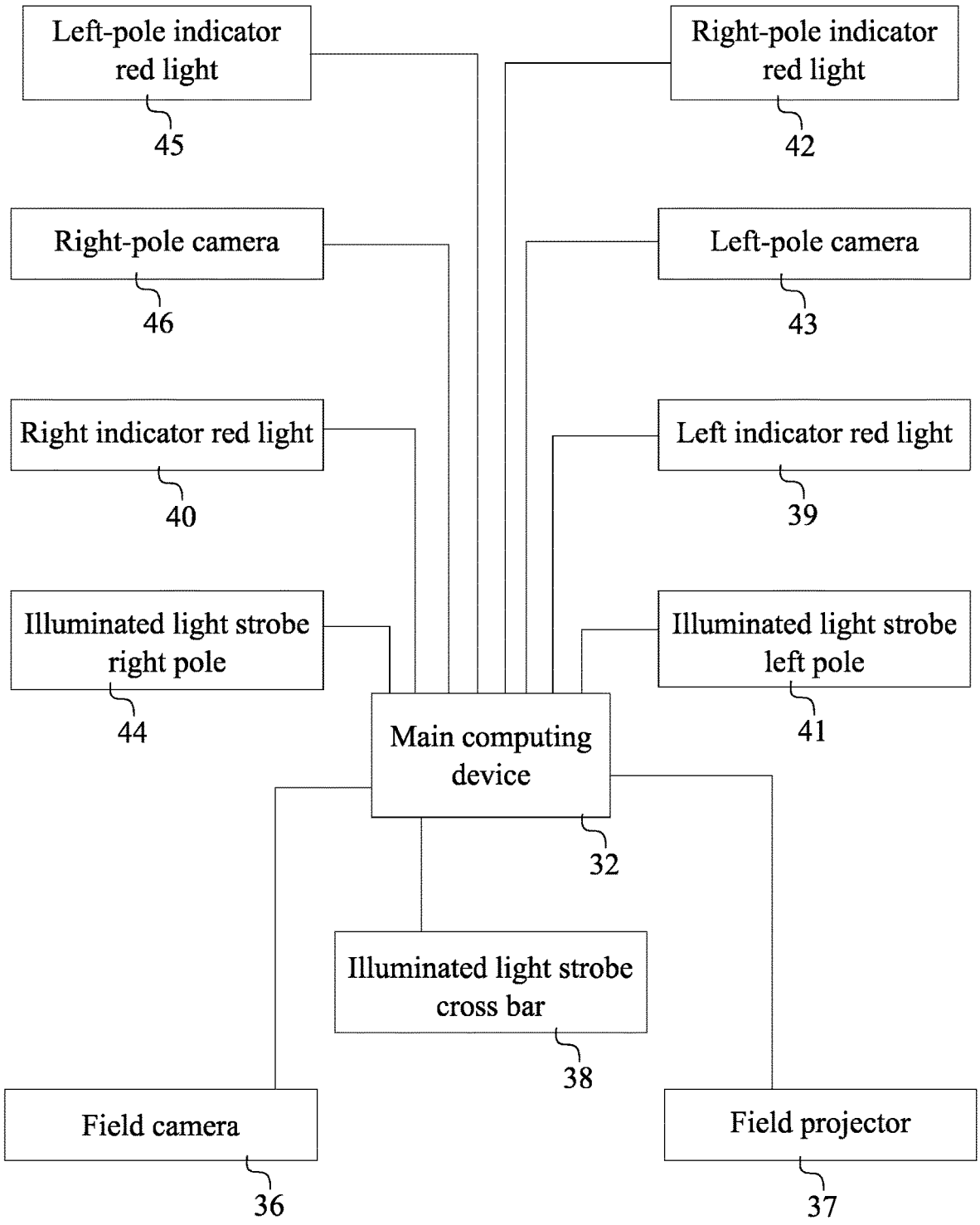
FIG. 32 is a schematic view showing the electrical connections between the main computing device and the foldable goal post.

In reference to FIG. 22, FIG. 23, and FIG. 32, the foldable reclining upright post 34 may further comprise a left-pole camera 43 and a right-pole camera 46 so that any scoring plays that use the foldable reclining upright post 34 can be automatically detected. More specifically, the left-pole camera 43 is terminally connected to the illuminated light strobe left pole 41 to determine whether the ball is traveled inside of the illuminated light strobe left pole 41 or outside of the illuminated light strobe left pole 41. The right-pole camera 46 is terminally connected to the illuminated light strobe right pole 44 and positioned opposite of the left-pole camera 43. Similarly, the right-pole camera 46 determines whether the ball is traveled inside of the illuminated light strobe right pole 44 or outside of the illuminated light strobe right pole 44. In order to complete the trajectory of the ball, the left-pole camera 43 and the right-pole camera 46 are electrically connected to the main computing device 32.

Figure 24:
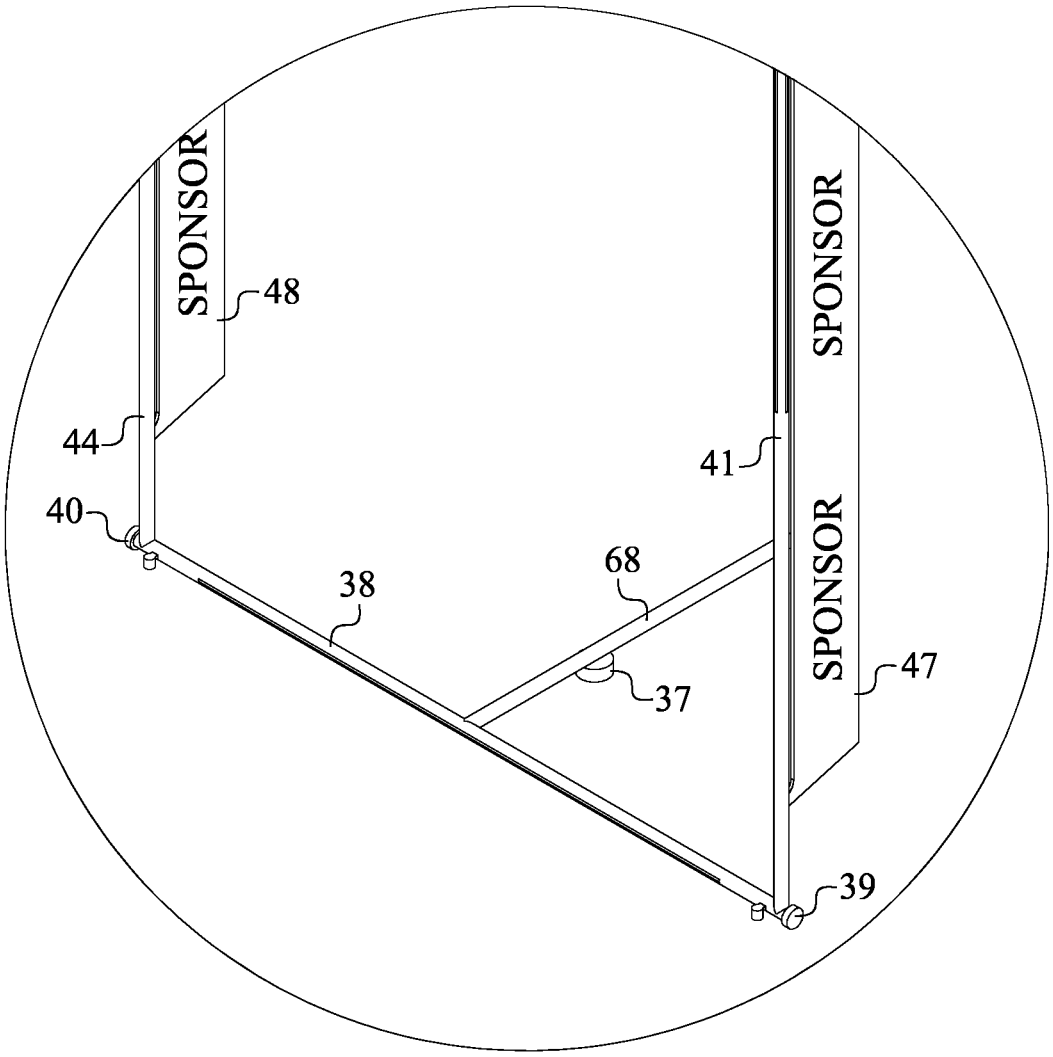
FIG. 24 is a detailed view showing illuminated cross bar of the foldable goal post of the present invention.

In reference to FIG. 24 and FIG. 32, the foldable reclining upright post 34 may further comprise a left indicator red light 39 and a right indicator red light 40 to visually indicate scoring plays of the game. More specifically, the left indicator red light 39 is terminally connected to the illuminated light strobe cross bar 38. The right indicator red light 40 is terminally connected to the illuminated light strobe cross bar 38 and positioned opposite of the left indicator red light 39. The left indicator red light 39 and the right indicator red light 40 are electrically connected to the main computing device 32 so that the left indicator red light 39 and the right indicator red light 40 can be illuminated according to the scoring plays of the game. For example, when the trajectory of the ball is within the illuminated light strobe left pole 41 and the illuminated light strobe right pole 44 and confirmed via the left-pole camera 43 and the right-pole camera 46, the main computing device 32 illuminates the left indicator red light 39 and the right indicator red light 40 with red color thus visually confirming the completion of the scoring play. When the trajectory of the ball is not within the illuminated light strobe left pole 41 and the illuminated light strobe right pole 44 and confirmed via the left-pole camera 43 and the right-pole camera 46, the main computing device 32 does not illuminate the left indicator red light 39 and the right indicator red light 40 with red color thus visually confirming the failure of the scoring play.

In reference to FIG. 22, FIG. 23, and FIG. 32, the foldable reclining upright post 34 may further comprise a left-pole indicator red light 42 and a right-pole indicator red light 45 to visually indicate scoring plays of the game. More specifically, the left-pole indicator red light 42 is terminally connected to the illuminated light strobe left pole 41. The right-pole indicator red light 45 is terminally connected to the illuminated light strobe right pole 44 and positioned opposite of the left-pole indicator red light 42. The left-pole indicator red light 42 and the right-pole indicator red light 45 are electrically connected to the main computing device 32 so that the left-pole indicator red light 42 and the right-pole indicator red light 45 can be illuminated according to the scoring plays of the game. For example, when the trajectory of the ball is within the illuminated light strobe left pole 41 and the illuminated light strobe right pole 44 and confirmed via the left-pole camera 43 and the right-pole camera 46, the main computing device 32 illuminates the left-pole indicator red light 42 and the right-pole indicator red light 45 with red color thus visually confirming the completion of the scoring play. When the trajectory of the ball is not within the illuminated light strobe left pole 41 and the illuminated light strobe right pole 44 and confirmed via the left-pole camera 43 and the right-pole camera 46, the main computing device 32 does not illuminate the left-pole indicator red light 42 and the right-pole indicator red light 45 with red color thus visually confirming the failure of the scoring play.

In reference to FIGS. 21-24, the foldable reclining upright post 34 may further comprise a left advertising panel 47 and a right advertising panel 48. The left advertising panel 47 is mounted along the illuminated light strobe left pole 41 and oriented towards the rear panel 6. The right advertising panel 48 is mounted along the illuminated light strobe right pole 44 and oriented towards the rear panel 6. As a result, the left advertising panel 47 and the right advertising panel 48 are able to provide additional advertising area without interfering with the rules of the game.

Figure 5:
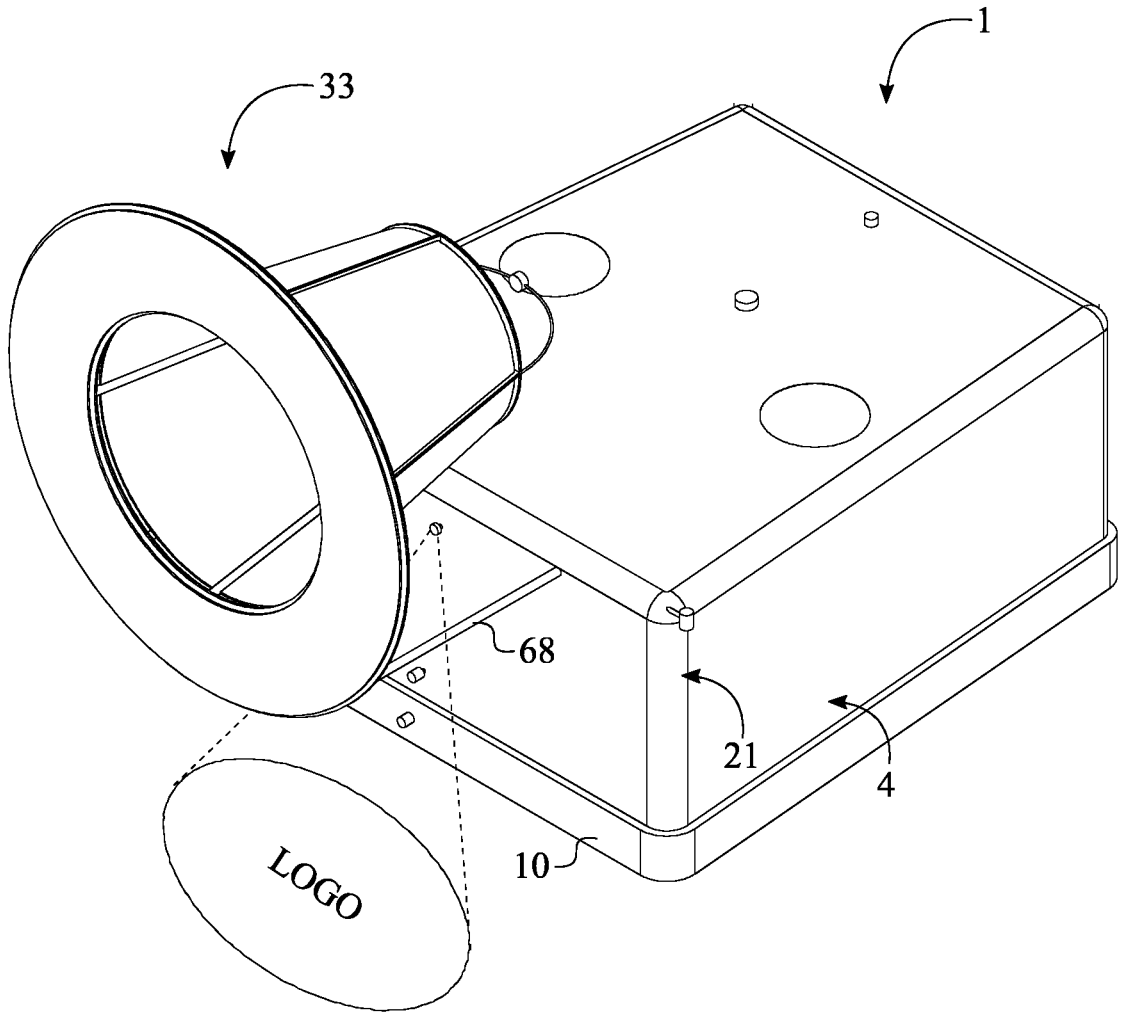
FIG. 5 is a perspective view of the present invention showing the annular target post.
Figure 6:
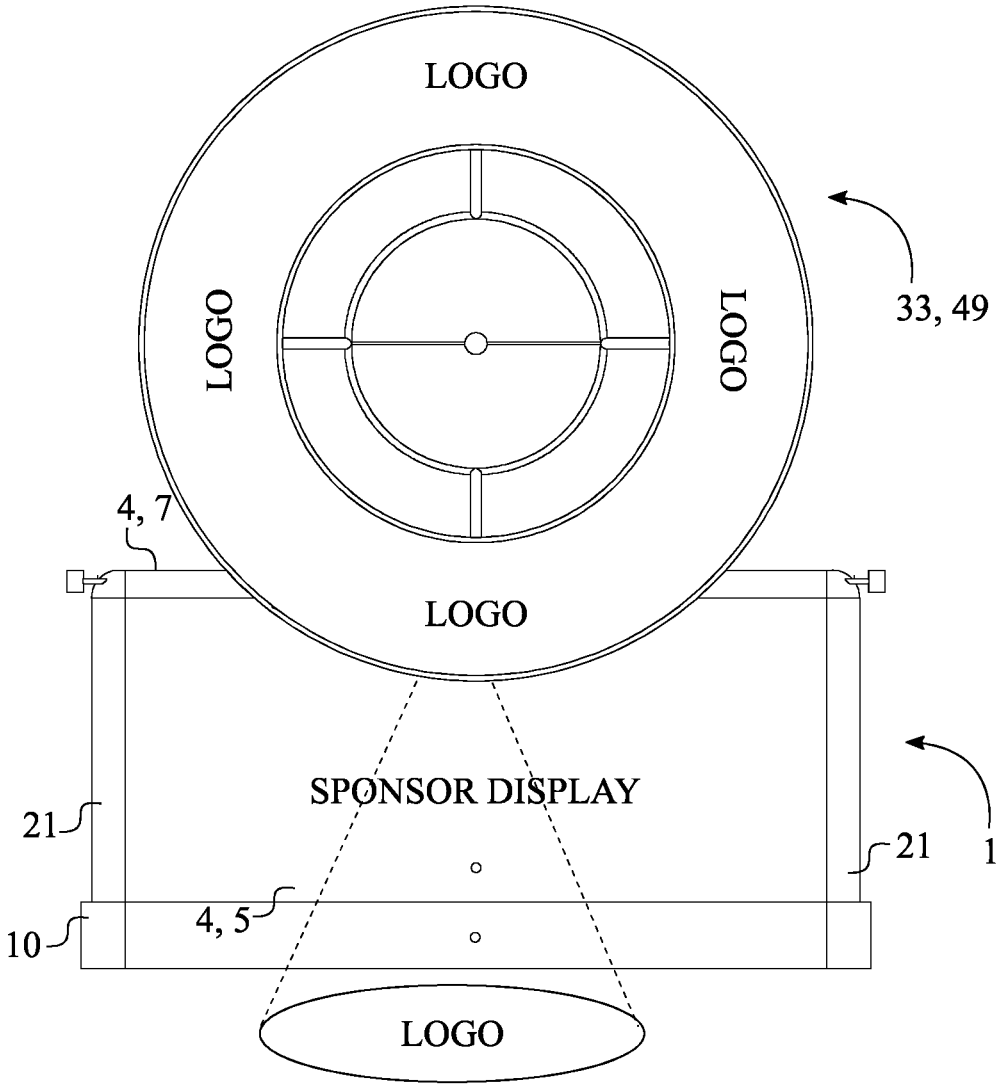
FIG. 6 is a front view of the present invention showing the annular target post.
Figure 7:
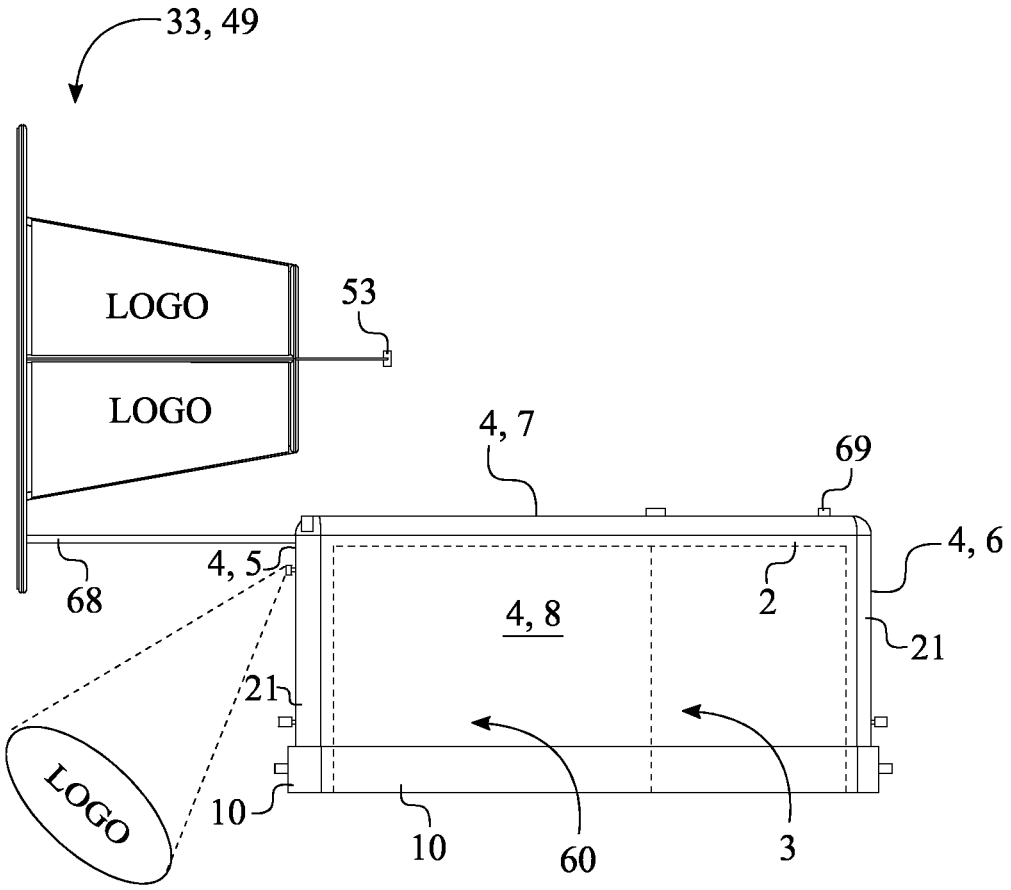
FIG. 7 is a side view of the present invention showing the annular target post.
Figure 8:
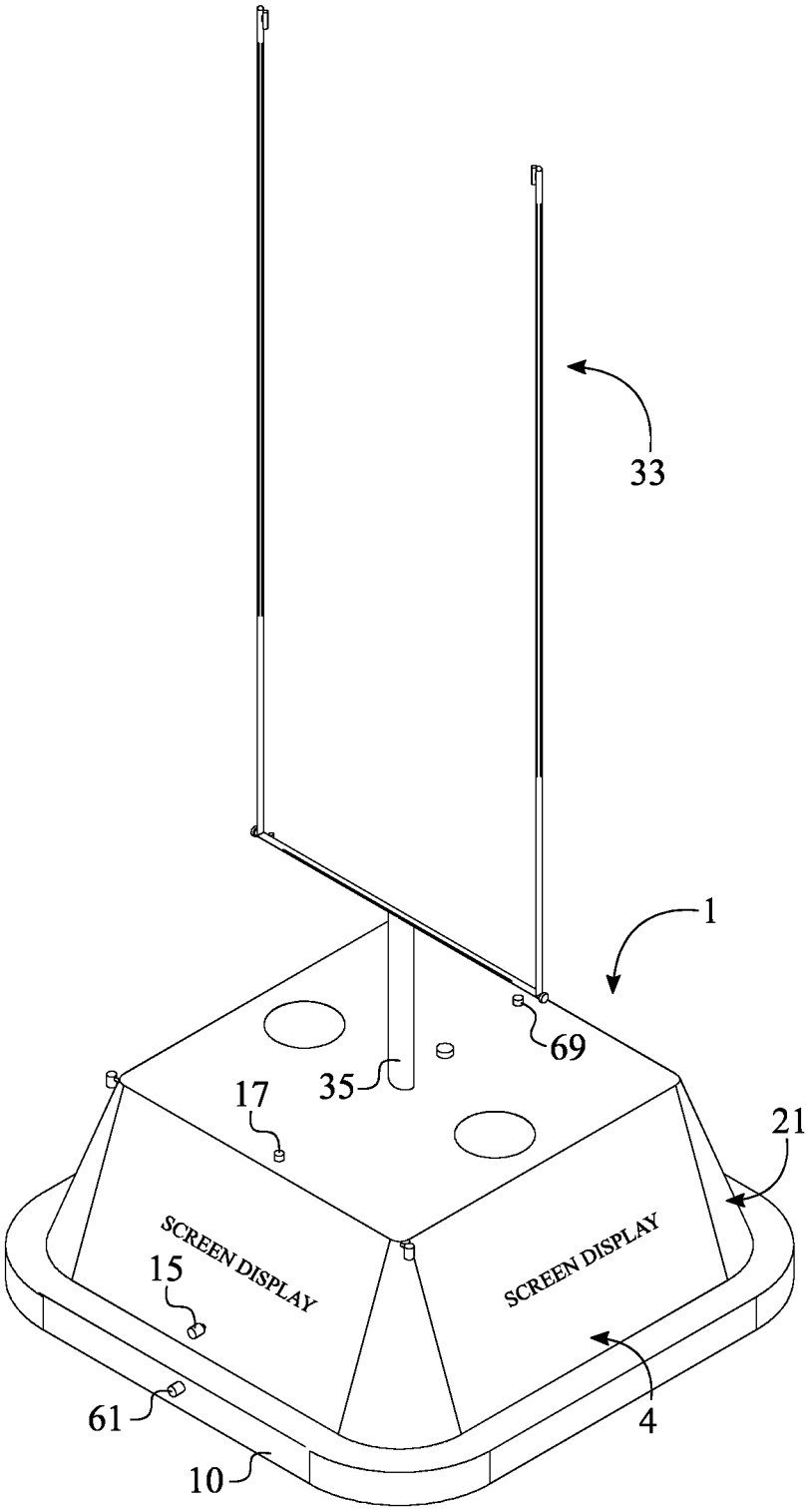
FIG. 8 is a perspective view of the present invention showing the foldable goal post.
Figure 9:
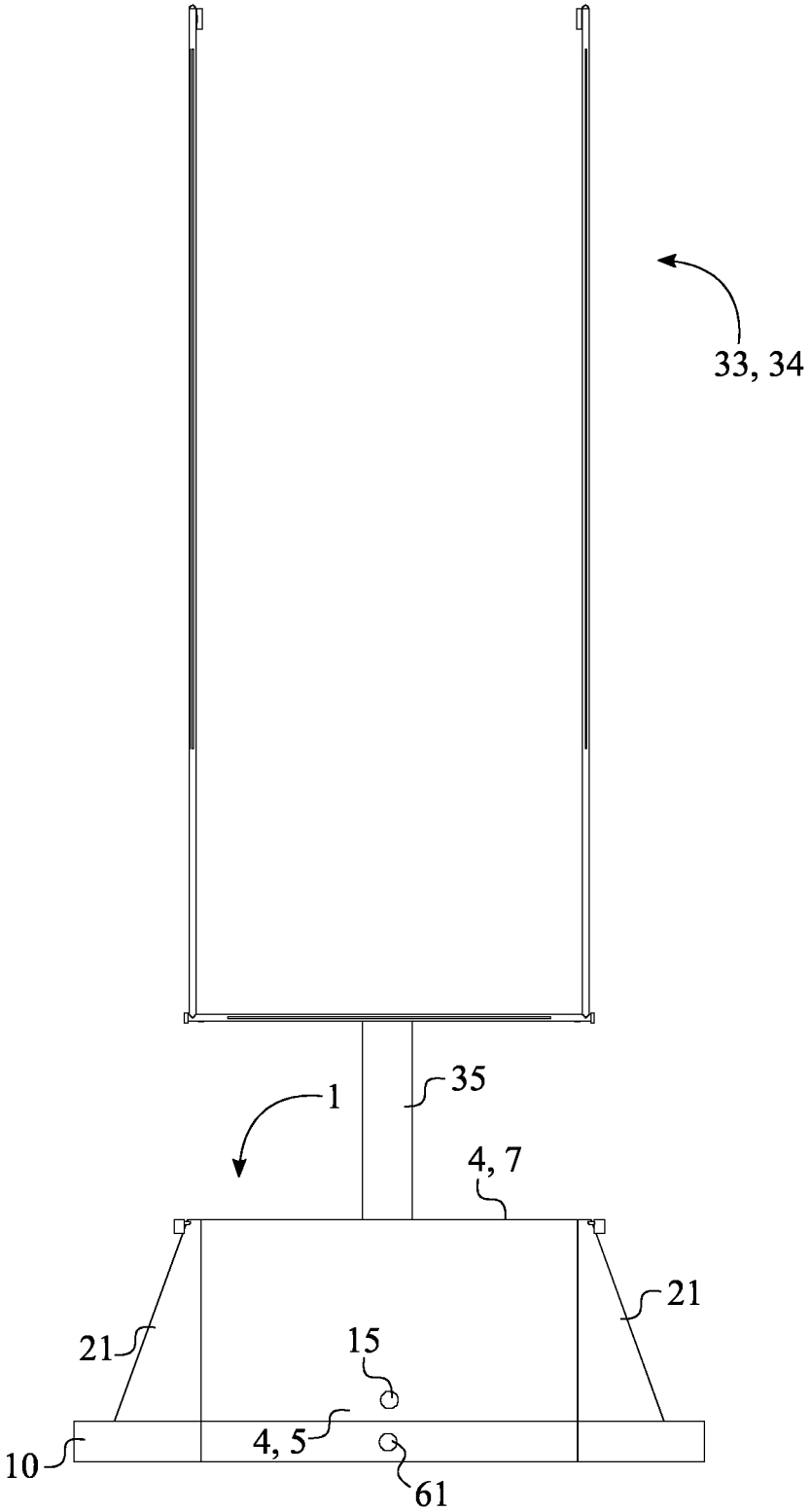
FIG. 9 is a front view of the present invention showing the foldable goal post.
Figure 10:
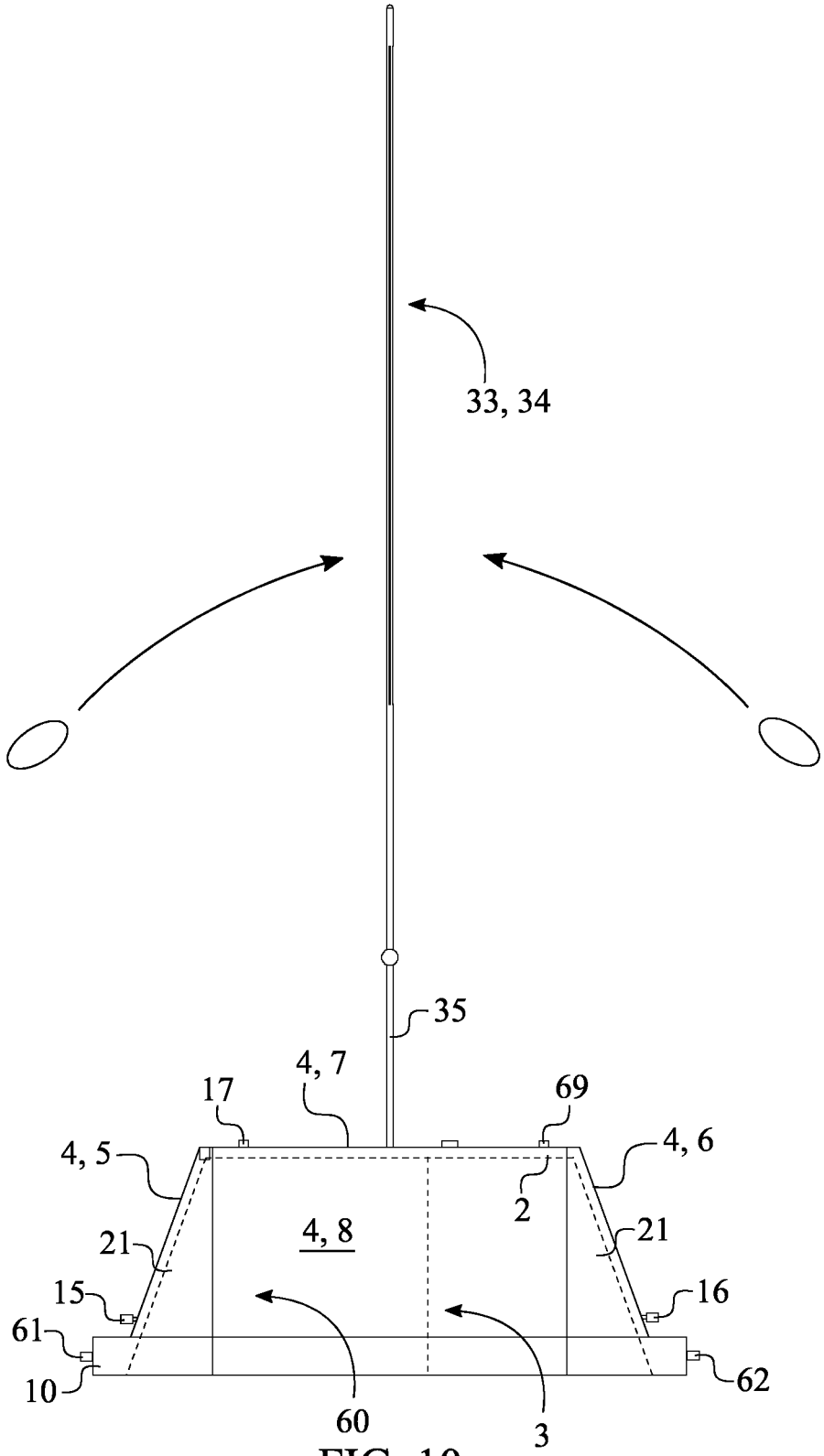
FIG. 10 is a side view of the present invention showing the foldable goal post.
Figure 25:
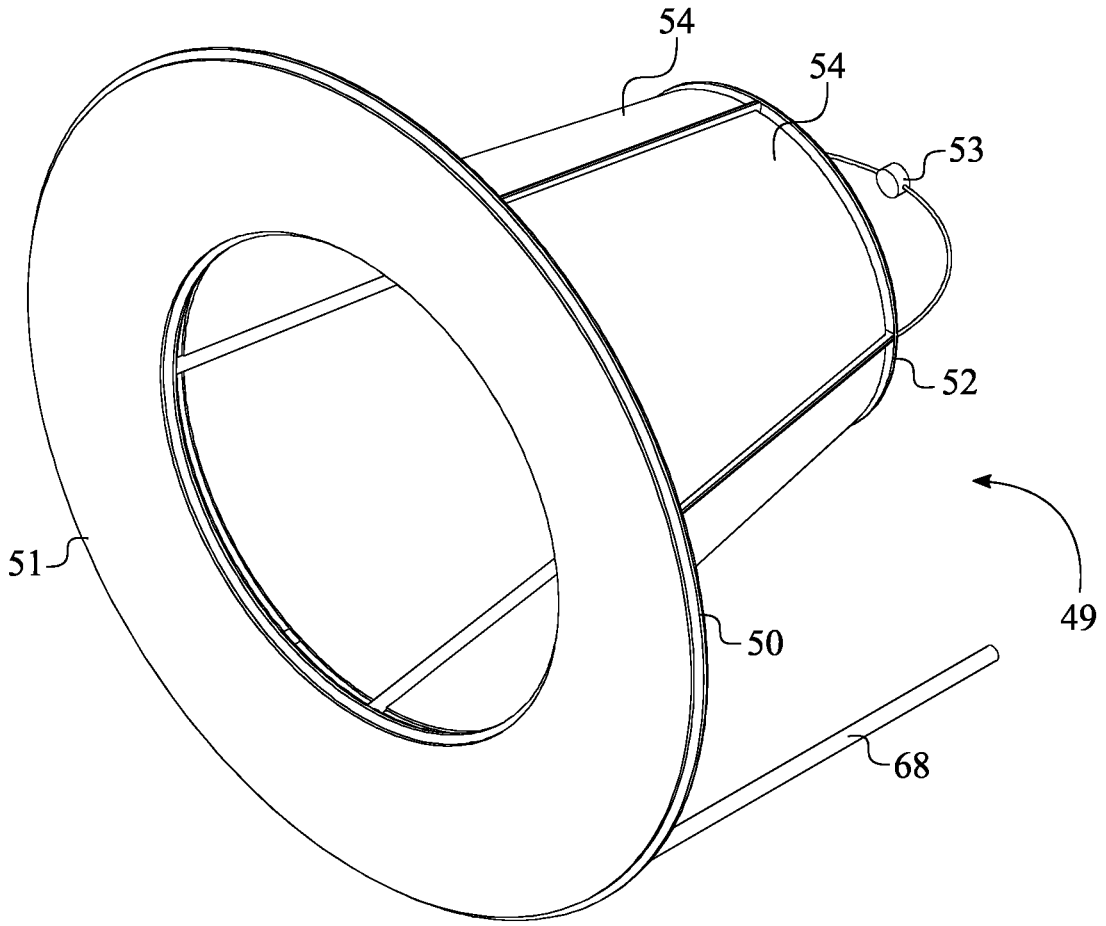
FIG. 25 is a front perspective view of the annular target post of the present invention.
Figure 26:
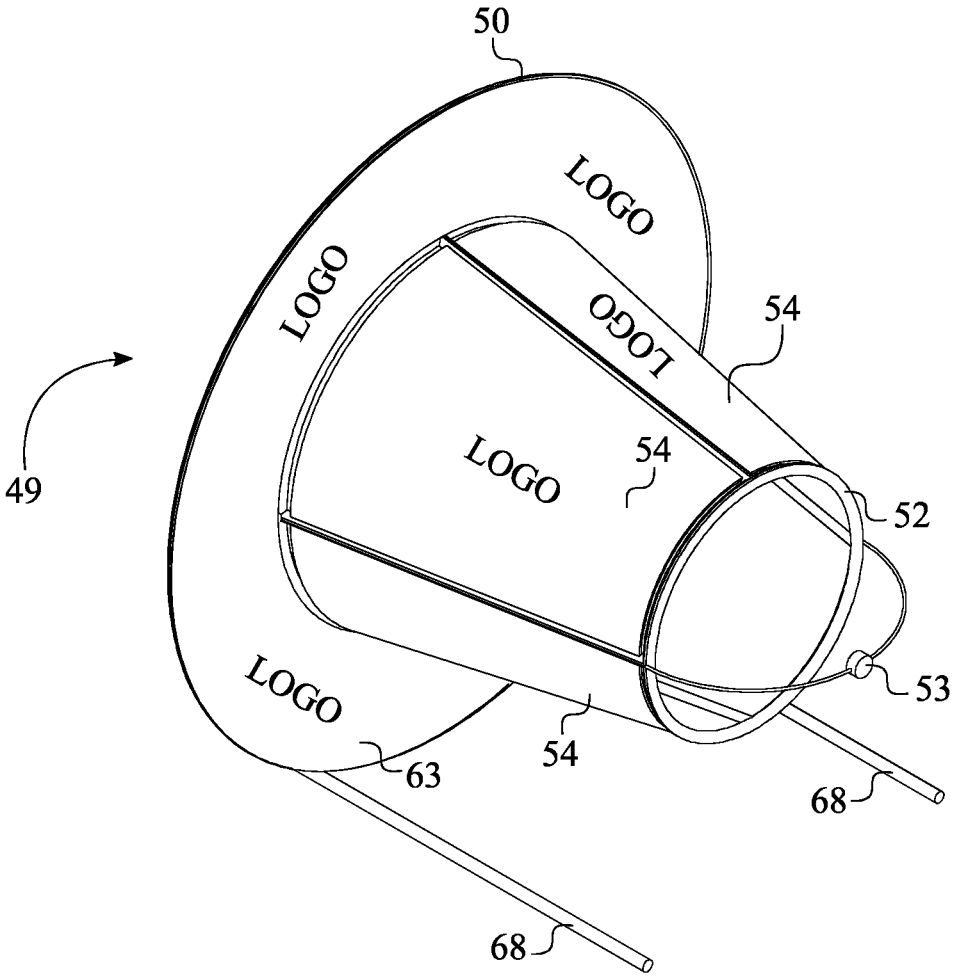
FIG. 26 is a rear perspective view of the annular target post of the present invention.
Figure 27:
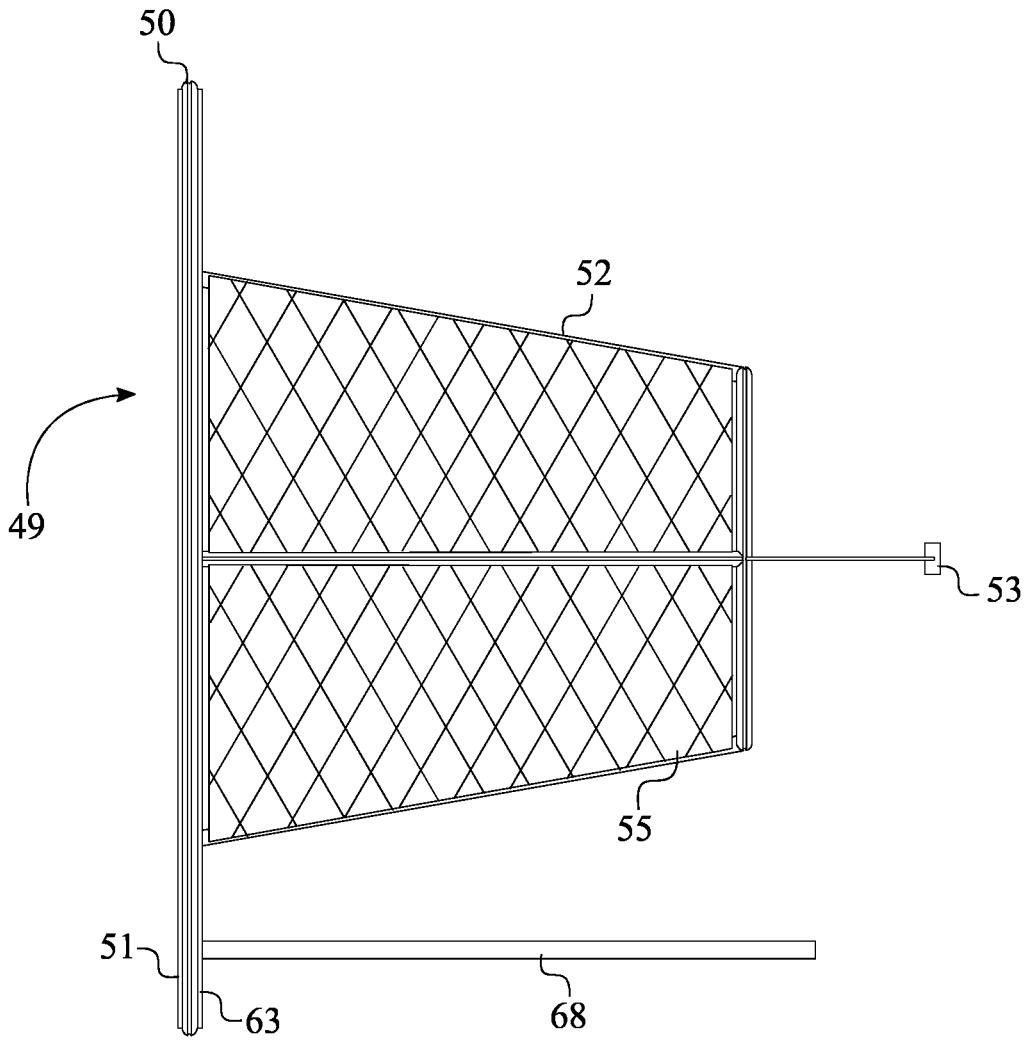
FIG. 27 is a side view of the annular target post of the present invention.
Figure 28:
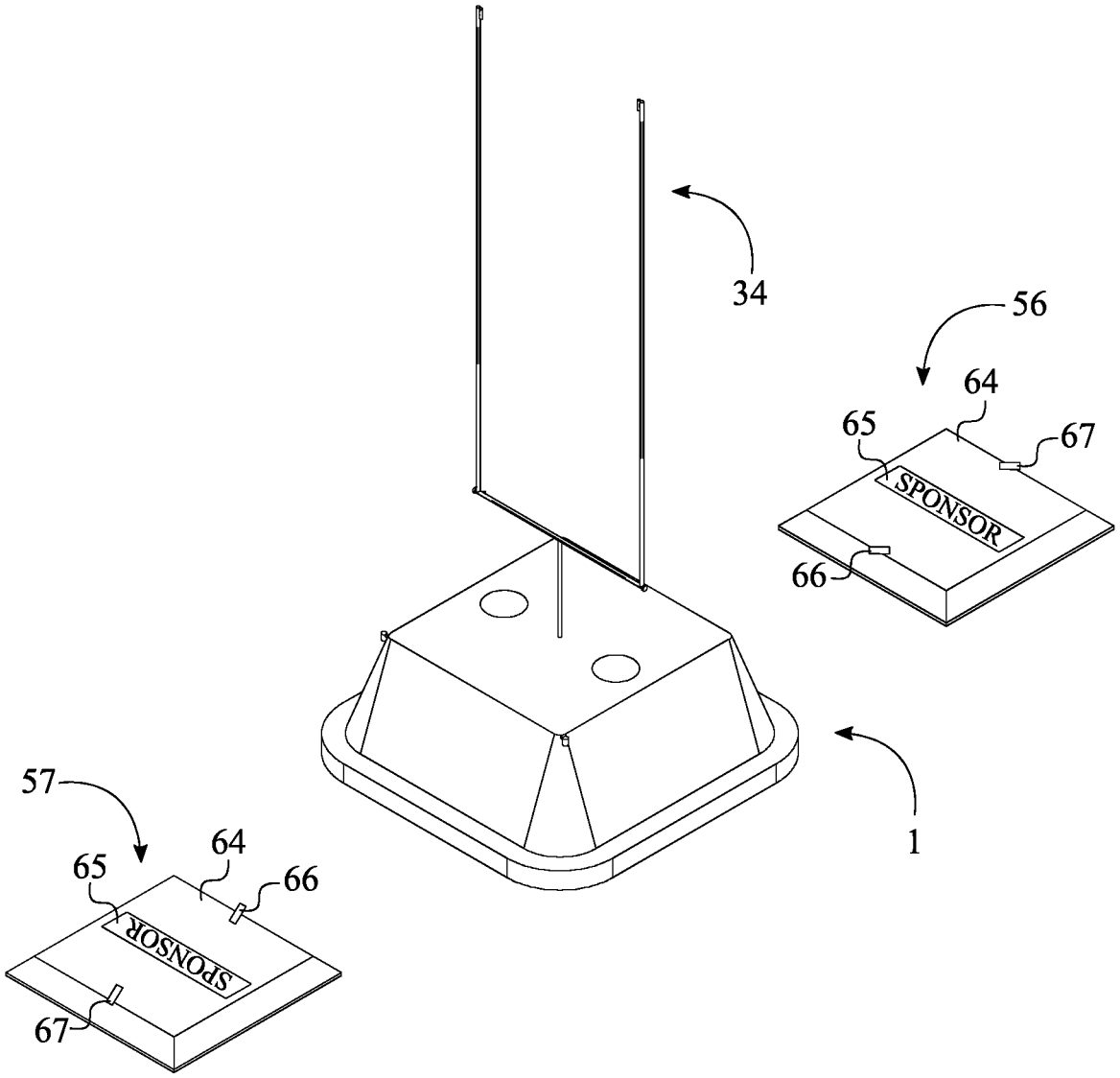
FIG. 28 is a perspective view of the present invention showing the freestanding media structure, the foldable goal post, the first player platform, and the second player platform.
Figure 29:
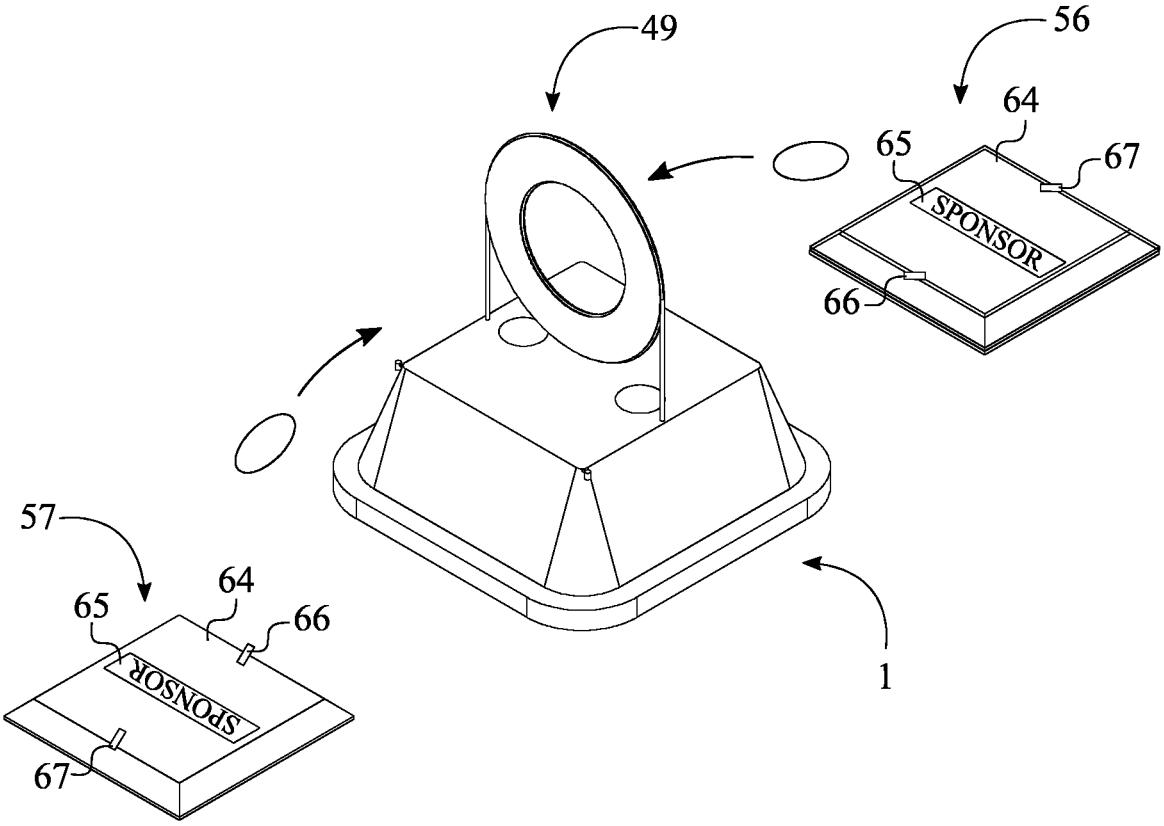
FIG. 29 is a perspective view of the present invention showing the freestanding media structure, the annular target post, the first player platform, and the second player platform.

In reference to FIGS. 25-27, in some embodiment of the present invention, the sporting game-scoring structure 33 comprises an annular target goal post display 49 that is similar to a ring-shaped structure. The annular target goal post display 49 is electrically connected to the main computing device 32 so that the operators can control specific feature of the annular target goal post display 49. As shown in FIGS. 25-27 and FIG. 33, the annular target goal post display 49 may comprise an illuminated light strobe annular frame 50, and at least one front electronic display panel 51, and at least one rear electronic display panel 63. The illuminated light strobe annular frame 50 is mounted to the frame 2 in such a way that the illuminated light strobe annular frame 50 is linearly extended from the left panel 8 to the right panel 9. The front electronic display panel 51 is perimetrically mounted to the illuminated light strobe annular frame 50. The rear electronic display panel 63 is perimetrically mounted to the illuminated light strobe annular frame 50 and positioned opposite of the front electronic display panel 51. The illuminated light strobe annular frame 50, the front electronic display panel 51, rear electronic display panel 63 are electrically connected to the main computing device 32 so that the operators are able to maximize the corresponding functionality of each component. For example, the illuminated light strobe annular frame 50 can be activated via the main computing device 32 when each time a goal is scored, at the beginning of the game, and at the end of the game. It is preferred that the illuminated light strobe annular frame 50 radially integrated with at least one waterproof stadium LED row for maximum illumination. The illuminated light strobe annular frame 50 delivers a high-intensity flashing effects that are produced by rapid electrical discharges to visually enhance the user experience. The front electronic display panel 51 and the rear electronic display panel 63 are preferably utilized to display advertisements, game information, or any other types of digital images. In reference to a first embodiments of the annular target goal post display 49, the annular target goal post display 49 further comprises the telescopic support arm 68 and the at least one field projector 37. The telescopic support arm 68 is retractably mounted to the frame 2 as shown in FIGS. 5-7. More specifically, the telescopic support arm 68 functions as a mounting member of the annular target goal post display 49 so that the illuminated light strobe annular frame 50 can be retractably mounted to the frame 2 by the telescopic support arm 68. The telescopic support arm 68 is symmetrically positioned in between the left panel 8 and the right panel 9 and outwardly extended from the front panel 5. As a result, the illuminated light strobe annular frame 50 can move toward the front panel 5 or move away from the front panel 5. Preferably, the retractable movement of the annular target goal post display 49 is operated through the main computing device 32 as the support post 35 is electrically connected to the main computing device 32. Furthermore, the at least one field projector 37 that can project an image onto the field/ground is mounted onto the front panel 5 and electrically connected to the main computing device 32 so that the projected image can be visible underneath the illuminated light strobe annular frame 50 or the telescopic support arm 68. The first embodiments of the annular target goal post display 49 can be utilized within modified rules of the football game, the rugby game, or any other games that require similar goalpost. Furthermore, the first embodiments of the annular target goal post display 49 only utilizes the fourth camera 69 within the advertising displaying freestanding media structure 1 as the foldable reclining upright post 34 annular target goal post display 49 is positioned offset from the front panel 5.

Figure 11:
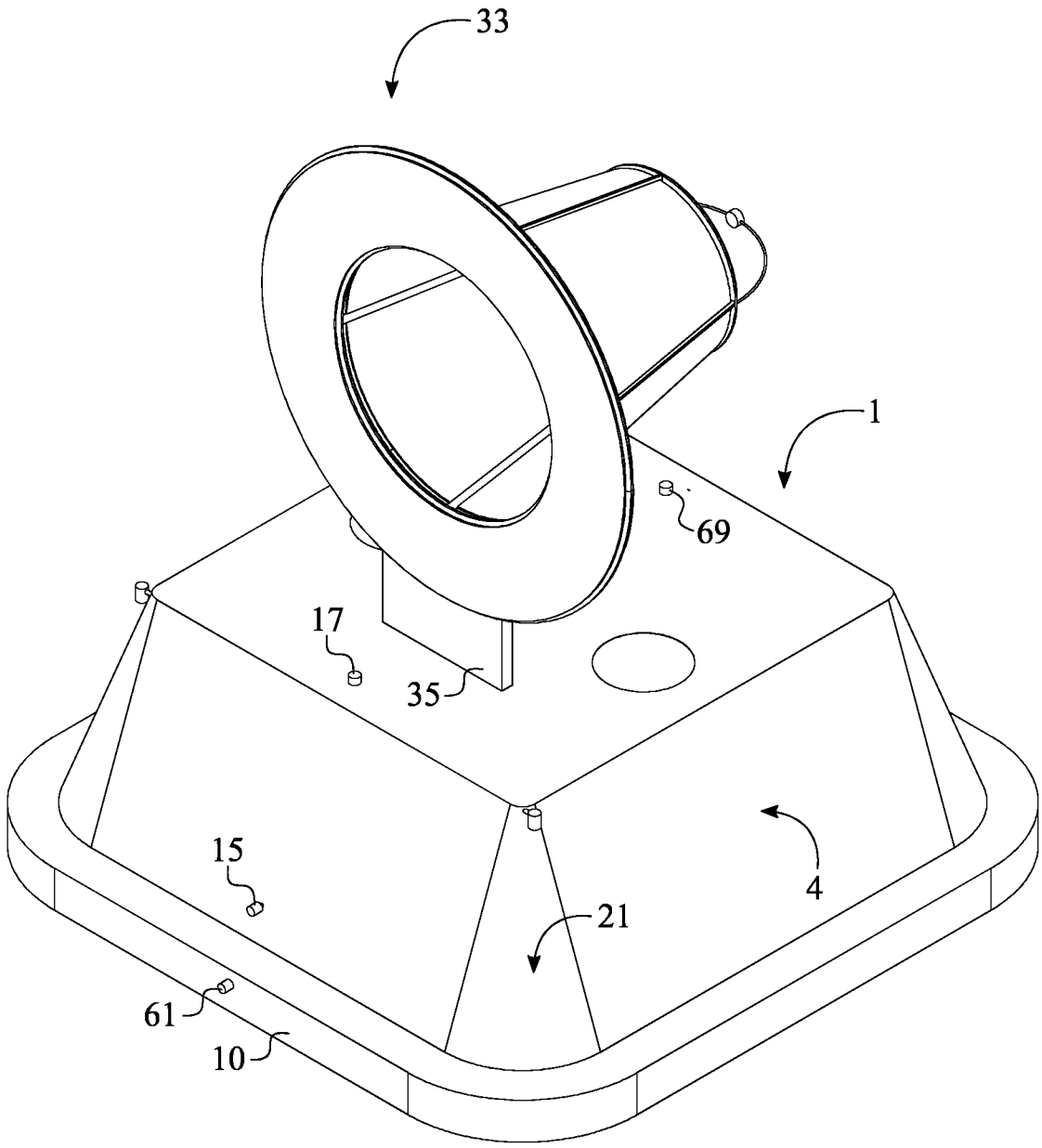
FIG. 11 is a perspective view of the present invention showing the annular target post.
Figure 12:
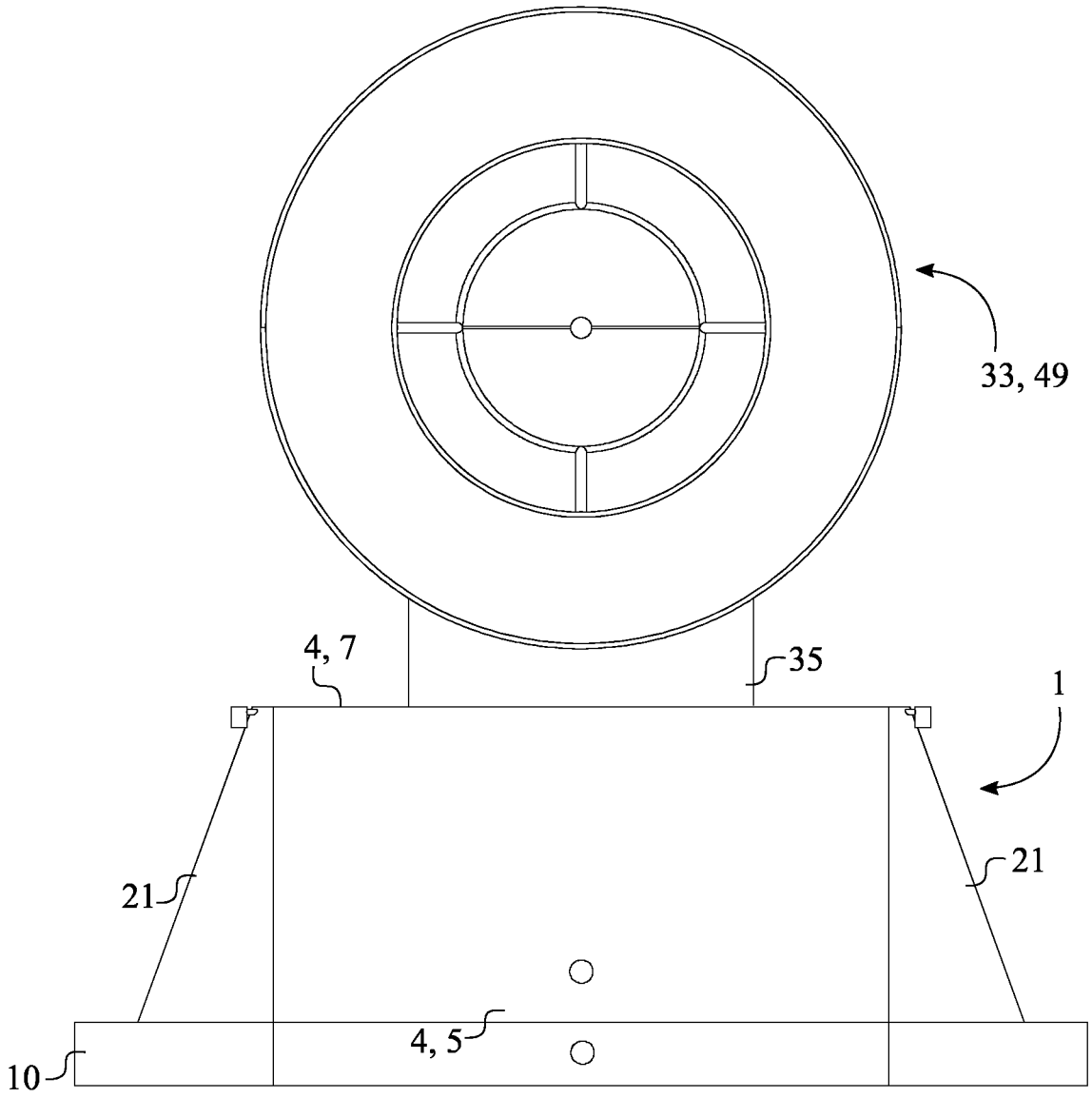
FIG. 12 is a front view of the present invention showing the annular target post.
Figure 13:
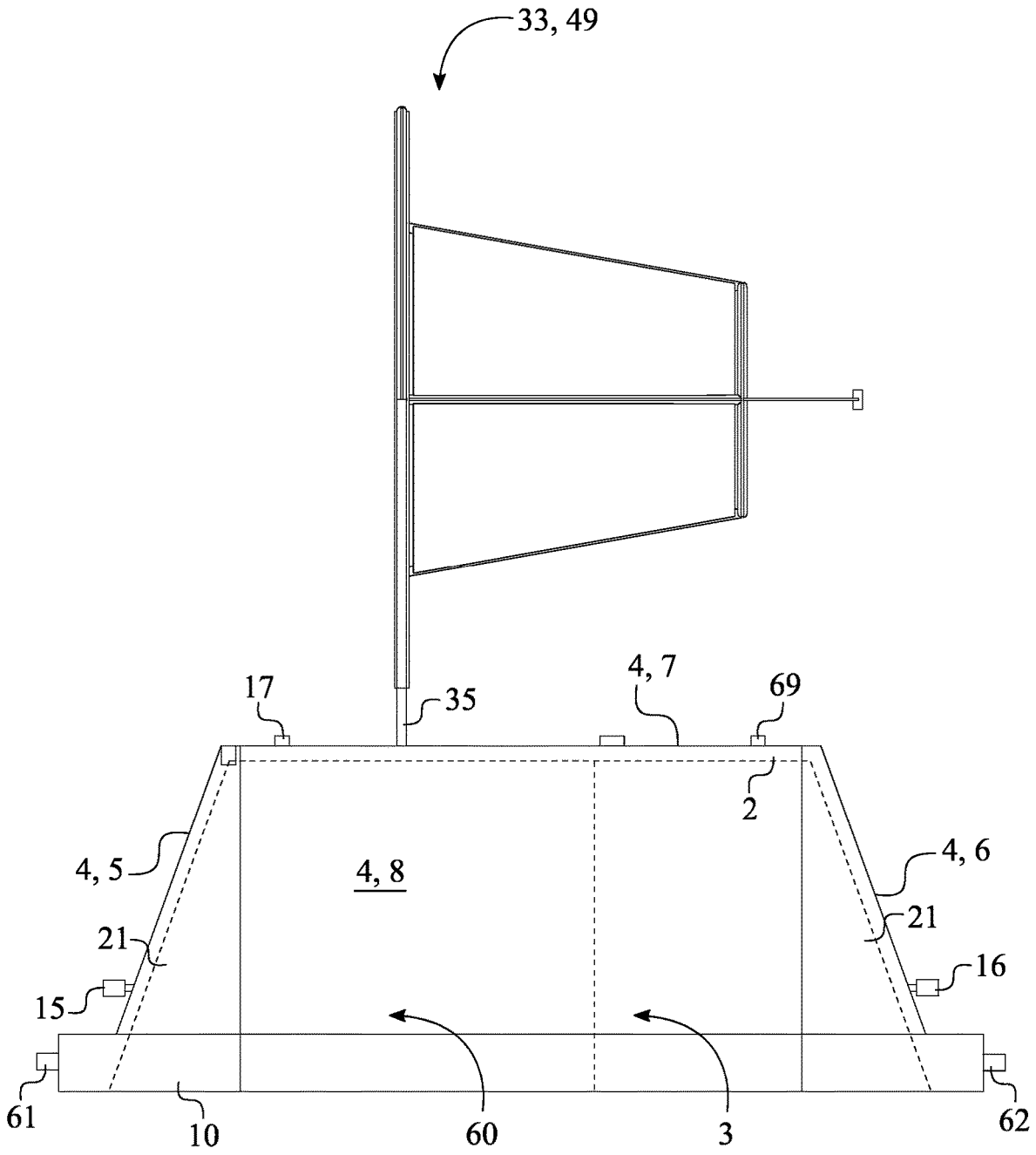
FIG. 13 is a side view of the present invention showing the annular target post.

In reference to a second embodiments of the annular target goal post display 49, the annular target goal post display 49 further comprises at least one support post 35 that is mounted to the frame 2 as shown in FIGS. 11-13. The support post 35 is adjacently positioned on the top panel 7 and outwardly extended from the top panel 7 so that the illuminated light strobe annular frame 50 can be mounted to the frame 2 by the support post 35. Resultantly, the illuminated light strobe annular frame 50 is positioned within the lower perimeter signage display ring 10. The second embodiment of the annular target goal post display 49 can be utilized with a new type of game that may result in the present invention further comprising the first player platform 56 and the second player platform 57. More specifically, the advertising displaying freestanding media structure 1 is centrally positioned in between the first player platform 56 and the second player platform 57 as the sporting game-scoring structure 33 (the annular target goal post display 49) is adjacently positioned atop the top panel 7. The first player platform 56 is diametrically opposed of the second player platform 57 so that multiple players can stand on each of the platforms to execute the game of play. Furthermore, the second embodiments of the annular target goal post display 49 utilizes both the third video camera 17 and the fourth camera 69 within the advertising displaying freestanding media structure 1 as the annular target goal post display 49 is centrally positioned within the top panel 7.

Figure 33:
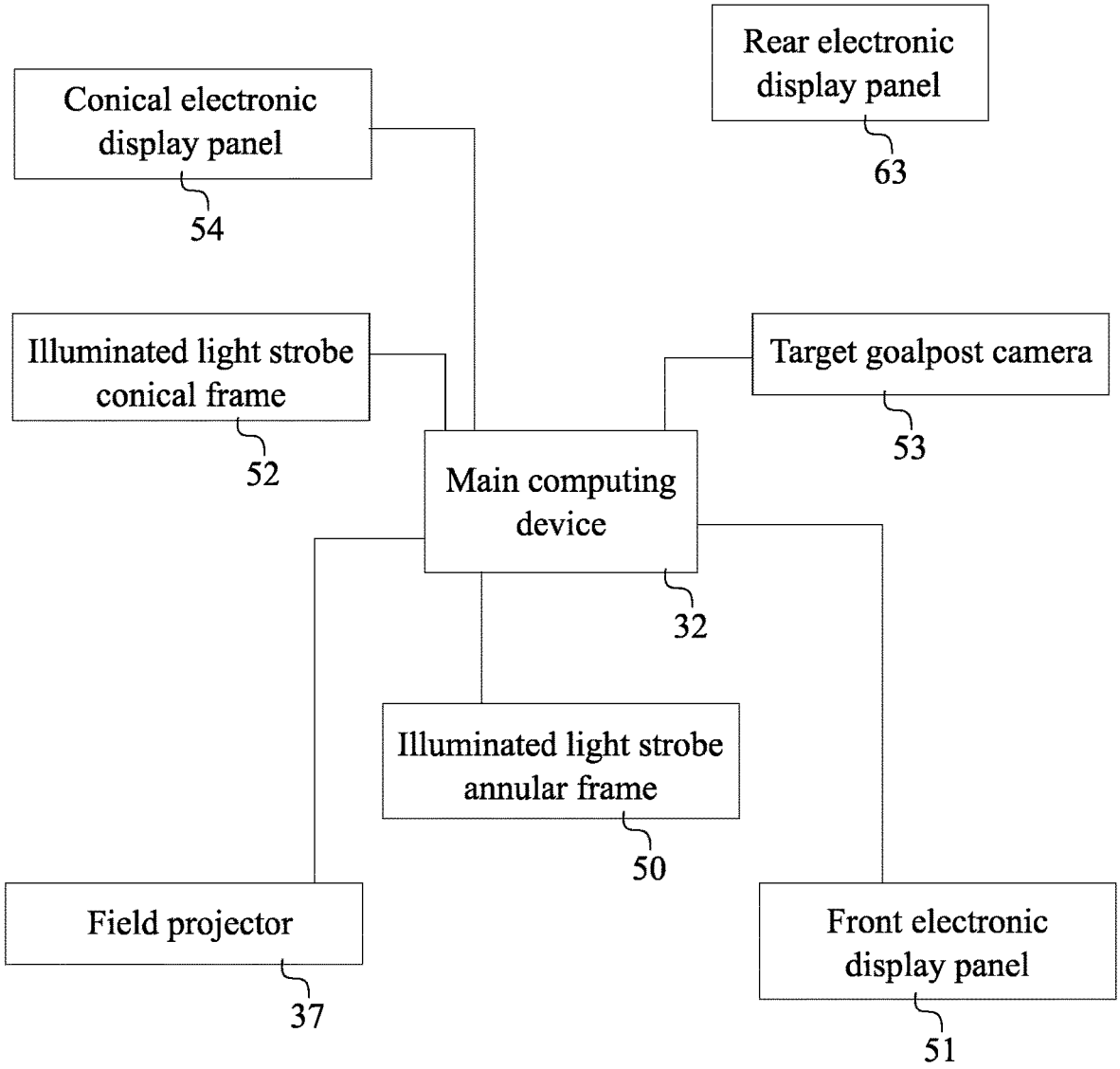
FIG. 33 is a schematic view showing the electrical connections between the main computing device and the annular target post.

In reference to FIG. 25, FIG. 26, and FIG. 33, the annular target goal post display 49 may further comprise an illuminated light strobe conical frame 52 to provide additional visual effects. More specifically, the illuminated light strobe conical frame 52 is concentrically mounted to the illuminated light strobe annular frame 50 and oriented towards the rear panel 6. The illuminated light strobe conical frame 52 is electrically connected to the main computing device 32 so that the lighting effects of the illuminated light strobe conical frame 52 can be activated each time a goal is scored, at the beginning of the game, and at the end of the game.

In reference to FIG. 26, FIG. 27, and FIG. 33, the present invention may further comprise at least one target goalpost camera 53 to determine the trajectory of a ball, steam the trajectory of the ball, and broadcast the trajectory of the ball. More specifically, the at least one target goalpost camera 53 is concentrically positioned to the annular target goal post display 49 and externally mounted to the illuminated light strobe conical frame 52 so that the at least one target goalpost camera 53 does not interfere with the ball during the scoring process. The target camera is electrically connected to the main computing device 32 so that the corresponding video files can be transmitted into the main computing device 32.

In reference to FIG. 25, FIG. 26, and FIG. 33, the annular target goal post display 49 may further comprise at least one conical electronic display panel 54 to display additional adverting information. More specifically, the conical electronic display panel 54 is perimetrically positioned around the illuminated light strobe conical frame 52 and externally mounted to the illuminated light strobe conical frame 52 without interfering the functionality of the illuminated light strobe conical frame 52. The conical electronic display panel 54 is electrically connected to the main computing device 32 thus allowing the operators to selectively display advertisements or game information.

In reference to FIG. 27, the annular target goal post display 49 may further comprise a net 55 instead of the conical electronic display panel 54. More specifically, the net 55 is perimetrically positioned around the illuminated light strobe conical frame 52 and externally mounted to the illuminated light strobe conical frame 52. The net 55 is utilized to retain the ball or any other object that travels through the illuminated light strobe conical frame 52 for safety purposes.

Figure 34:
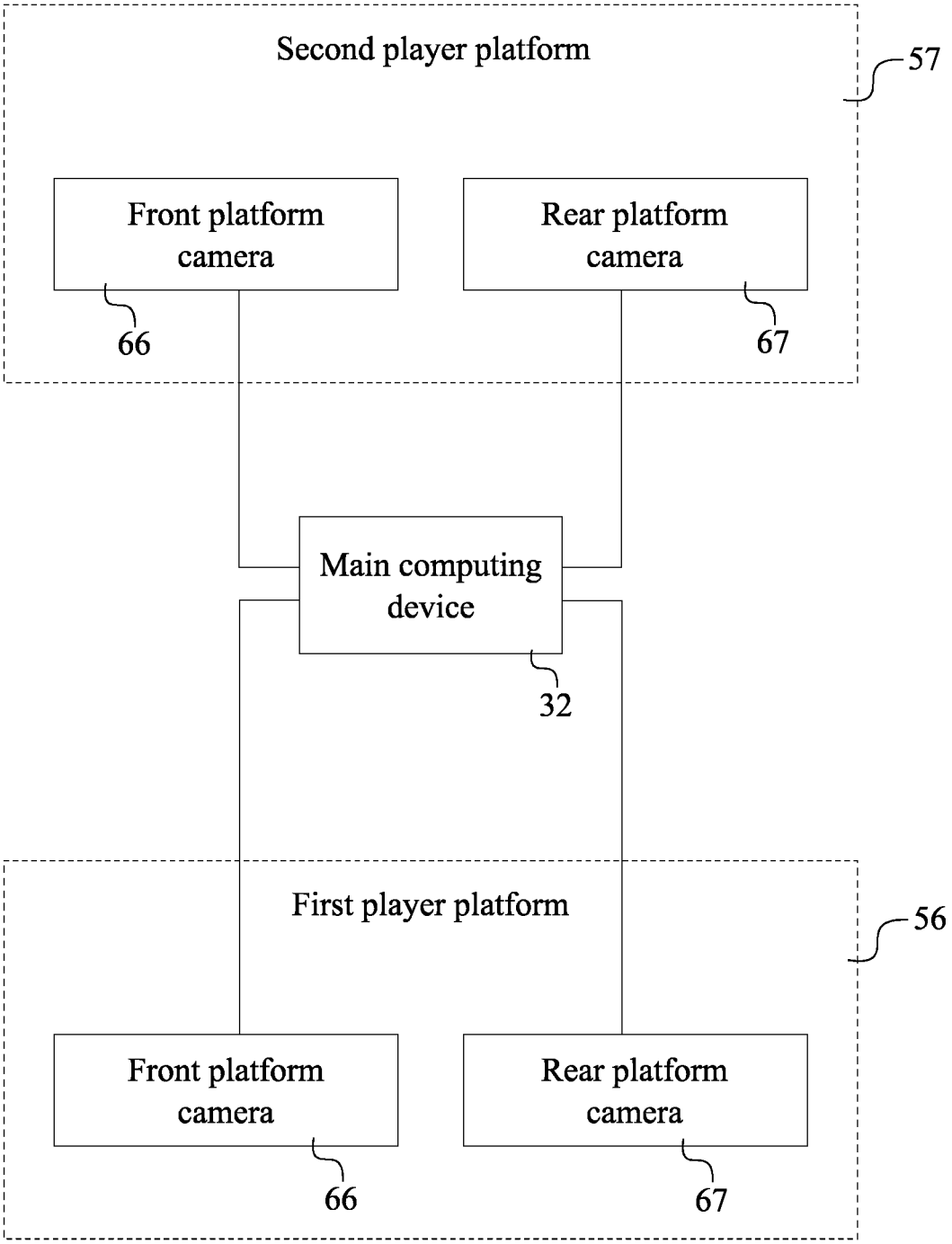
FIG. 34 is a schematic view showing the electrical connections between the main computing device and the first and second player platforms.
Figure 35:
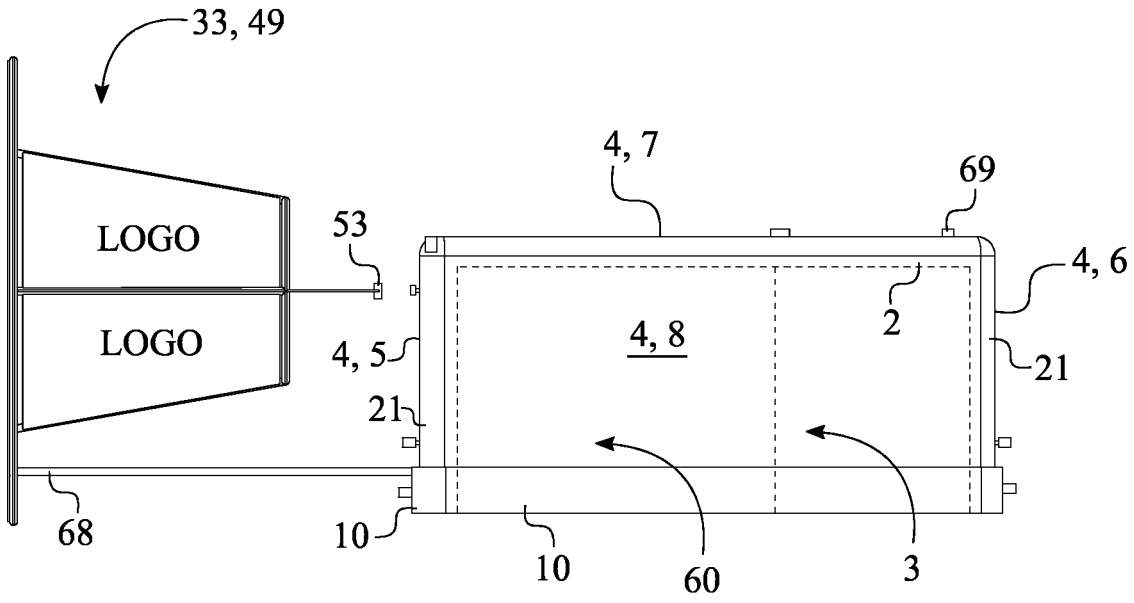
FIG. 35 is a side view of the present invention showing the annular target post.

In reference to FIG. 34, the first player platform 56 and the second player platform 57 may each comprise a platform body 64, at least one sponsor display panel 65, a front platform camera 66, and a rear platform camera 67. The at least one sponsor display panel 65 is integrated onto the platform body 64 to display advertisement or other types of images. The front platform camera 66 and the rear platform camera 67 that function a pair of video cameras are oppositely positioned of each other about the platform body 64. More specifically, the front platform camera 66 and the rear platform camera 67 are mounted to the platform body 64 and oriented toward the advertising displaying freestanding media structure 1 so that the any player activities on the platform body 64 can be recorded or broadcasted. As a result, the front platform camera 66 and the rear platform camera 67 are electrically connected to the main computing device 32.

Supplemental Description

The present invention is a Freestanding Structural Display Apparatus for Sport Goalpost known as the goalpost of the future used for next generation sport disciplines and other purpose. It is a revolutionary goalpost technology sport field equipment made with many AV and Branding technology, and digital features mostly for to use of sport competition by the professional and amateur athletes.

Not limited for animation activities and recreation games, the invention can be mounted anywhere, any surface, any frame and structures use with any number of players to perform target practice activity to improve precision by hand throwing and goal kick using any type of traditional ball, object, instrument, and devices, including the use of digital balls technology.

With the Freestanding Structural Display Apparatus for Sport Goalpost, mostly for use for the new revolutionary sport of the future using the annular target goalpost display OR the next generation American Football to be positioned in different configuration of any field play and pitch. The camera technology use by Freestanding Structural Display Apparatus for Sport Goalpost is mainly use during live sporting events for video production, Television Broadcasting, live streaming technology, OTT (over-the-top), media and digital services, such as mobile app services, social media performs all to better serve the sports industry and the sport fans. Both the Freestanding Structural Display Apparatus for Sport Goalpost are connected to each other with the electronic line mark field play or pitch between them, all design to work together to keep tracking the game play and action during a live game and also use for entertainment purpose. The electronic and lighting strip system line mark technology is integrated or incorporated to the Line marking of sports fields, to any artificial turf or natural grass or wood and rubber ground surface, this electronic line mark technology is not limited for any sport using any types of field play or pitch, in outdoor and indoor stadiums or arena, courts, race track, etc., to name a few: include field play for American and Canadian football, soccer, futsal, rugby, baseball, handball, cricket, lacrosse, field and ice hockey, basketball. This electronic and digital lighting line mark system for Field or Pitch are design to light up on any sport field play and pitch during any live sport events, the line mark such as the hash lines, yard lines, side lines, end zone, goal lines, half field mark, circle center line, corner marks, any line mark layout made between the goal lines marks, the base line and between the goal posts.

The line marks can light up in various colors and be flashing, this offers the ability to inform the position of the ball or game play on the field play and also use for entertainment purpose.

The Freestanding Structural Display Apparatus for Sport Goalpost includes multitudes electronic and digital technologies integrated to the annular frame known as the O-Rings goalpost. Specifically, the present invention includes multimedia advertising and sponsor technology, Scoring entertainment system for referrer and fan engagement, LED displays, three-dimensional (3D) hologram projectors, camera devices, logo projectors, signage perimeter screen display. The LED display screen is designed to work together with the above-cited technologies to introduce a new way of scoring, projecting 3D hologram content, outputting player announcements and official sponsor logos, and offering a new and unique scoring entertainment celebration experience. This new sport is designed to be played with two teams on an innovative tradition and electronic field with a pair of Freestanding Structural Display Apparatus for Sport Goalpost and uses two types of match balls.

New Sport disciplines that are play by using Hand Throws and Kicking techniques to name a few such Football Quarterback competition and Football Field Goal Kicks and more, that involves multiple sports disciplines uses the latest innovative goalpost technology in a new field layout configuration that employs unique line mark positions. Each athlete will be required to use multiple skills and talents and have the ability to use multiple variation of techniques and sport rules from various sports disciplines. This will enable the play of a unique and revolutionary sport that combines America Football, Soccer, Rugby, Basketball, and Handball. Thus, creating the ultimate field sport of the 21st century. This new sport requires supreme physical and mental ability forces each athlete to learn multiple sport techniques to play these multi-disciplinary sports used by next generation athletes. The next generation of mix sports, making it the sport of the future and exclusively for unique talent so future athletes will become "super elite athletes." The present invention includes a large variety of technology such as electronic and digital devices implemented that is necessary to the new sports, athletes, and fan base. For example, cameras are mounted to the present invention and are designed to capture live broadcasting video from the field of play. This live streaming video content can be used to assist officials referees when determining if a goal was scored, if a field goal kick and football throwing or a ball throw is required and various other conditions on the field play. Additionally, this information can be broadcasted and recorded live from any sport event and on any outdoor or indoor facilities, using live streaming, OTT Technology and simultaneously recorded real-time broadcast to mobile devices and TV Screens. Addition to the live video streaming, the present invention introduces a new technology called live streaming 3D hologram projection. This live streaming 3D hologram projection technology consists of 3D hologram projections that is floating in mid-air from the Freestanding Structural Display Apparatus for Sport Goalpost or not limned to any field goalpost frame, field play of any sports projecting 3D hologram content that can be seen in midair from any angles and direction or around the Freestanding Structural Display Apparatus and the Sport Goalpost frame and field of play. The 3 Dimension hologram imaging is transmitted simultaneously in real time from the Freestanding Structural Display and the goalpost to reach millions of mobile devices and TV Screens by receiving the same live 3D floating imaging in mid-air that pops up from the goalpost and field play, using methods of live 3 Dimension hologram broadcasting technology, 3 D hologram live streaming technology, or any digital 3D hologram technology design to transmit 3D imaging to mobile devices during any live sport events using any goalpost on a field play or pitch. Freestanding Structural Display Apparatus for Sport Goalpost's 3D hologram projection imaging consists of first introducing the official scoring goal or point by announcing the player and team jersey with his or her name and number that has scored the goal or point by projecting the 3D hologram imaging of the sponsor, brand logo, advertising, company product and names, including entertaining and advertising content projections. The live streaming content and 3D hologram projection live streaming technology is used for covering the live sport events and is designed to prove new experience to share the excitement with the sport fan using mobile devices and TV Screens. The present invention is designed to launch new sport disciplines using modern goalpost technology for national competition and international championships tournaments that is broadcast and sponsored to better serve millions of fans worldwide. This method and technology are not limited for other sports and events, amateur and professional sports organized by professional sport leagues and federations. The present invention is designed to live streaming from any sport events and on any field of play during live sport event played outdoor or indoor and simultaneously using any recorded broadcasting technology and live streaming technology to be transmitted to mobile devices and TV Screens in real time not limned to virtual broadcast technology. Both video contents and live streaming contents capture from the scoring goal, including the live 3D hologram contents project it during the live sport event are design for the live scoring goal mobile app and live streaming service to helps sport fans keep up with all the results and scores from their favorite teams with the live content to be transmitted in real time to mobile device via live video live streaming technology, Not limited of the use of any technology and electronic equipment oriented toward the goal line and game play, design to capture live broadcast and Filming production content made from the field stadium goalpost and around the goalpost frame to transmitted the live content from the goalpost on the field play to mobile devices, during the live sport events, sport official matches such as professional sport leagues, and during championship tournaments, This new solution offers new modern methods and advantages addressed to the sport fans so they can at any time received an update of any live professional and amateur sport events to receive a full live scoring goal or point action from the capture live video content and 3D Hologram projection from the goalpost to mobile devices simultaneously, all without having to be a live spectator in the stadium or watching the game on TV Screen. Thus, generating new digital entertainment value. Also the present invention is design to announce the player and team that has scored a goal or point will be introduce and announced by a 3D hologram projection imaging content project the player's jersey, player uniform, team logo, sponsor logo, advertising image and video contents, including 3D animation, during live sport event to be seen by the live audience in the stadium and the TV viewers can be seen in real time, and transmitted via live streaming and the use of any digital broadcasting technology to mobile devices. The live-scores goal is the accurate and most complete Hand-football app to bringing fastest live Hand-football scores and sport breaking news from the actual annular goalpost and multimedia display live scoring video covering and 3D projection straight to your mobile devices. Not limited to watch the full game from the cameras mounted on the target goalposts and can be use with or without the use of mobile applications service. The camera devices and 3D projector devices mounted to the Freestanding Structural Display Apparatus for Sport Goalpost are design to provide content for the mobile devices and TV Screen. The purpose of the cameras is to capture the live video contents of goals being scored, following with the 3D Hologram projection of 3D floating images to announce the team's player's jersey, team logo, company sponsor, advertising, products and services. The information is intended to be transmitted to mobile devices and TV Screen during the live sports event using Digital Broadcasting, OTT technology and live streaming technology so recipient can receive and view the same video content of the live scoring goal to be seen in a the 3D hologram floating imaging content that pop up in midair from any mobile devices, and TV screens to reach millions of sport fan using their Mobile device such as smart phones, tablets, PC computers, TV screens, watches and wireless electronic mobile devices. This technology is not limited to other sports having Freestanding Structural Display Apparatus for Sport Goalpost on any field of play, playing with any ball and objects in outdoor and indoor stadium, arenas, courts, ice fields, and water fields, not limited to winter sport, summer sports. When this new scoring app technology is used during live sport events and competitions by any TV networks, such as (NFL) National Football League, NCAA College Football, NBA National Basketball Association, FIFA World Cups and FIFA Confederation Cups and UEFA tournaments. Further, the present invention primarily designed to professional sport leagues and the Olympic Games but is not limited to other sports such as baseball, basketball, American football, tennis, ice and field hockey, handball, soccer, rugby, cricket, lacrosse, and polo, to name a few non limiting examples.

The Camera devices and the 3D hologram projectors are not limited to using the wireless communication network technology, Additionally, the Freestanding Structural Display Apparatus for Sport Goalpost having the camera devices and the 3Dimension Hologram projector use for the purpose of sport entertainment games, electronic table game, recreation activity game, E-sport games, throwing target game, including annular frame use multi sports for amateur and professional athletes to improve precision to the hand throw and goal kick a ball and use with other instruments or device use in sport such as batt, racket. The Freestanding Structural Display Target Goalpost can be implemented to other traditional sports. Also, can be used for Handball hand throw practice, Soccer goal kick target practice, for American football quarterbacks for target practice to improve hand throw precision. Baseball player practicing target practice throwing the fastball using baseball ball and player baseball bat hits the ball, basketball hoops target practice using a ball, cricket target practice using cricket bat, lacrosse target practice using cork, ice hockey target practice using the hockey stick. The annular target goalpost can be used in a fixed position and while in motion for a more challenging target practice sport competition and experience. Additionally, the invention Freestanding Structural Display Apparatus for Sport Goalpost is designed to be used manually or electronically for other purpose such as sport activity games and playground recreation game, table sports games, leisure and entertainment games using any ball, objects, instrument, and electronic device by performing hand throw and goal kick directly or indirectly to the target goalposts. The athlete can use the hands and feet to perform target practice.

The invention is also designed for digital games using the Freestanding Structural Display Apparatus for Sport Goalpost functionality and design to offer new solution to be incorporated for e-sports as a new generation of active video games and e-sports games. 2D and 3D animation games, and gaming, this innovative concept offers unlimited possibly.

Although the invention has been explained in relation to its preferred embodiment, it is to be understood that many other possible modifications and variations can be made without departing from the spirit and scope of the invention as hereinafter claimed.

What is claimed is:

1. A freestanding structural display apparatus for sport goalpost comprising:

an advertising displaying freestanding media structure;

a main computing device;

a sporting game-scoring structure;

the advertising displaying freestanding media structure comprising a frame, a control room, a plurality of electronic screen display panels, a lower perimeter signage display ring, and a plurality of output panels;

the plurality of electronic screen display panels comprising a front panel, a rear panel, a top panel, a left panel, and a right panel;

the frame being laterally enclosed by the front panel, the rear panel, the left panel, the right panel, and the plurality of output panels;

the lower perimeter signage display ring and the top panel being oppositely position of each other about the frame;

the top panel being connected onto the frame;

the top panel being positioned within the front panel, the rear panel, the left panel, and the right panel;

the lower perimeter signage display ring being laterally connected around the frame;

the lower perimeter signage display ring being adjacently positioned to the front panel, the rear panel, the left panel, and the right panel;

the control room being internally connected to the frame;

the main computing device being positioned within the control room;

the sporting game-scoring structure being connected to the frame;

the sporting game-scoring structure being positioned atop the top panel; and the plurality of electronic screen display panels, the lower perimeter signage display ring, the plurality of output panels, and the sporting game-scoring structure being electrically connected to the main computing device.

2. The freestanding structural display apparatus for sport goalpost as claimed in claim 1 further comprising:

a first drone platform;

a first lifting mechanism;

a second drone platform;

a second lifting mechanism;

the first drone platform and the second drone platform being integrated into the top panel;

the first drone platform being adjacently positioned to the left panel;

the second drone platform being adjacently positioned to the right panel;

the first drone platform being operatively coupled to the frame by the first lifting mechanism, wherein the first lifting mechanism vertically moves the first drone platform in and out of the control room;

the second drone platform being operatively coupled to the frame by the second lifting mechanism, wherein the second lifting mechanism vertically moves the second drone platform in and out of the control room;

the first lifting mechanism being electrically connected to the main computing device; and the second lifting mechanism being electrically connected to the main computing device.

3. The freestanding structural display apparatus for sport goalpost as claimed in claim 1 further comprising:

a first video camera;

a second video camera;

a third video camera;

a fourth video camera;

a first signage camera;

a second signage camera;

the first video camera being mounted to the frame;

the first video camera being positioned adjacent to the front panel;

the first video camera being oriented outward from the front panel;

the second video camera being mounted to the frame;

the second video camera being positioned adjacent to the rear panel;

the second video camera being oriented outward from the rear panel;

the first video camera and the second video camera being electrically connected to the main computing device;

the third video camera being mounted to the top panel;

the third video camera being positioned adjacent to the front panel;

the third video camera being oriented toward the sporting game-scoring structure;

the fourth video camera being mounted to the top panel;

the fourth video camera being positioned adjacent to the rear panel;

the fourth video camera being oriented toward the sporting game-scoring structure;

the third video camera and the fourth video camera being electrically connected to the main computing device;

the first signage camera being mounted to the lower perimeter signage display ring;

the first signage camera being positioned adjacent to the front panel;

the first signage camera being oriented outward from the front panel;

the second signage camera being mounted to the lower perimeter signage display ring;

the second signage camera being positioned adjacent to the rear panel;

the second signage camera being oriented outward from the rear panel; and the first signage camera and the second signage camera being electrically connected to the main computing device.

4. The freestanding structural display apparatus for sport goalpost as claimed in claim 1 further comprising:

a first ground logo projector;

a second ground logo projector;

the first ground logo projector and the second ground logo projector being mounted to the frame;

the first ground logo projector being positioned adjacent to the top panel, the front panel, and the left panel;

the second ground logo projector being positioned adjacent to the top panel, the front panel, and the right panel; and the first ground logo projector and the second ground logo projector being electrically connected to the main computing device.

5. The freestanding structural display apparatus for sport goalpost as claimed in claim 1 further comprising:

a 3D hologram projector;

the 3D hologram projector being mounted onto the top panel; and the 3D hologram projector being electrically connected to the main computing device.

6. The freestanding structural display apparatus for sport goalpost as claimed in claim 1 further comprising:

the plurality of output panels comprising a front-left panel, a front-right panel, a rear-left panel, and a rear-right panel;

the front-left panel being mounted in between the front panel and the left panel;

the front-right panel being mounted in between the front panel and the right panel;

the rear-left panel being mounted in between the rear panel and the left panel; and the rear-right panel being mounted in between the rear panel and the right panel.

7. The freestanding structural display apparatus for sport goalpost as claimed in claim 1 further comprising:

a retractable display system;

the retractable display system comprising a suspended structure, a first retractable sponsor flag display, a second retractable sponsor flag display, a third retractable sponsor flag display, and a fourth retractable sponsor flag display;

the suspended structure being mounted atop the advertising displaying freestanding media structure;

the suspended structure being linearly offset from the advertising displaying freestanding media structure;

the first retractable sponsor flag display, the second retractable sponsor flag display, the third retractable sponsor flag display, and the fourth retractable sponsor flag display being perimetrically mounted around the suspended structure; and the first retractable sponsor flag display, the second retractable sponsor flag display, the third retractable sponsor flag display, and the fourth retractable sponsor flag display being communicably coupled to the main computing device.

8. The freestanding structural display apparatus for sport goalpost as claimed in claim 1 further comprising:

the sporting game-scoring structure comprising a foldable reclining upright post;

the foldable reclining upright post comprising an illuminated light strobe cross bar, an illuminated light strobe left pole, and an illuminated light strobe right pole;

the illuminated light strobe cross bar being linearly extended from the left panel to the right panel;

the illuminated light strobe left pole and the illuminated light strobe right pole being positioned parallel to each other about the illuminated light strobe cross bar;

the illuminated light strobe left pole being terminally connected to the illuminated light strobe cross bar at a right angle;

the illuminated light strobe left pole being adjacently positioned to the left panel;

the illuminated light strobe left pole being perpendicularly positioned to the top panel;

the illuminated light strobe right pole being terminally connected to the illuminated light strobe cross bar at a right angle;

the illuminated light strobe right pole being adjacently positioned to the right panel;

the illuminated light strobe right pole being perpendicularly positioned to the top panel; and the illuminated light strobe cross bar, the illuminated light strobe left pole, and the illuminated light strobe right pole being electrically connected to the main computing device.

9. The freestanding structural display apparatus for sport goalpost as claimed in claim 8 further comprising:

the foldable reclining upright post comprising a telescopic support arm;

the telescopic support arm being retractably mounted to the frame;

the illuminated light strobe cross bar being retractably mounted to the frame by the telescopic support arm;

the telescopic support arm being symmetrically positioned in between the left panel and the right panel; and the telescopic support arm being outwardly extended from the front panel.

10. The freestanding structural display apparatus for sport goalpost as claimed in claim 9 further comprising:

the foldable reclining upright posting further comprising at least one field projector and at least one field camera;

the field projector being mounted to the telescopic support arm;

the at least one field camera being mounted to the telescopic support arm; and the felid projector and the at least one field camera being electrically connected to the main computing device.

11. The freestanding structural display apparatus for sport goalpost as claimed in claim 8 further comprising:

the foldable reclining upright post comprising a support post;

the illuminated light strobe cross bar being mounted to the frame by the support post;

the support post being adjacently positioned to the top panel; and the support post being outwardly extended from the top panel.

12. The freestanding structural display apparatus for sport goalpost as claimed in claim 8 further comprising:

the foldable reclining upright post further comprising a left indicator red light and a right indicator red light;

the left indicator red light being terminally connected to the illuminated light strobe cross bar;

the right indicator red light being terminally connected to the illuminated light strobe cross bar, opposite of the left indicator red light; and the left indicator red light and the right indicator red light being electrically connected to the main computing device.

13. The freestanding structural display apparatus for sport goalpost as claimed in claim 8 further comprising:

the foldable reclining upright post further comprising a left-pole indicator red light and a right-pole indicator red light;

the left-pole indicator red light being terminally connected to the illuminated light strobe left pole;

the right-pole indicator red light being terminally connected to the illuminated light strobe right pole, opposite of the left-pole indicator red light; and the left-pole indicator red light and the right-pole indicator red light being electrically connected to the main computing device.

14. The freestanding structural display apparatus for sport goalpost as claimed in claim 8 further comprising:

the foldable reclining upright post further comprising a left-pole camera and a right-pole camera;

the left-pole camera being terminally connected to the illuminated light strobe left pole;

the right-pole camera being terminally connected to the illuminated light strobe right pole, opposite of the left-pole camera; and the left-pole camera and the right-pole camera being electrically connected to the main computing device.

15. The freestanding structural display apparatus for sport goalpost as claimed in claim 8 further comprising:

the foldable reclining upright post further comprising a left advertising panel and a right advertising panel;

the left advertising panel being mounted along the illuminated light strobe left pole; and the right advertising panel being mounted along the illuminated light strobe right pole.

16. The freestanding structural display apparatus for sport goalpost as claimed in claim 1 further comprising:

the sporting game-scoring structure comprising an annular target goal post display;

the annular target goal post display comprising an illuminated light strobe annular frame, at least one front electronic display panel, and at least one rear electronic display panel;

the illuminated light strobe annular frame being linearly extended from the left panel to the right panel;

the front electronic display panel being perimetrically mounted to the illuminated light strobe annular frame;

the rear electronic display panel being perimetrically mounted to the illuminated light strobe annular frame, opposite of the front electronic display panel; and the illuminated light strobe annular frame, the front electronic display panel, and the rear electronic display panel being electrically connected to the main computing device.

17. The freestanding structural display apparatus for sport goalpost as claimed in claim 16 further comprising:

the annular target goal post display comprising a telescopic support arm;

the illuminated light strobe annular frame being retractably mounted to the frame by the telescopic support arm;

the telescopic support arm being symmetrically positioned in between the left panel and the right panel; and the telescopic support arm being outwardly extended from the front panel.

18. The freestanding structural display apparatus for sport goalpost as claimed in claim 17 further comprising:

the annular target goal post display further comprising at least one field projector;

the field projector being mounted onto the front panel; and the felid projector being electrically connected to the main computing device.

19. The freestanding structural display apparatus for sport goalpost as claimed in claim 16 further comprising:

the annular target goal post display comprising a support post;

the illuminated light strobe annular frame being mounted to the frame by the support post;

the support post being adjacently positioned to the top panel; and the support post being outwardly extended from the top panel.

20. The freestanding structural display apparatus for sport goalpost as claimed in claim 16 further comprising:

the annular target goal post display further comprising an illuminated light strobe conical frame;

the illuminated light strobe conical frame being concentrically mounted to the illuminated light strobe annular frame;

the illuminated light strobe conical frame being oriented towards the rear panel; and the illuminated light strobe conical frame being electrically connected to the main computing device.

21. The freestanding structural display apparatus for sport goalpost as claimed in claim 20 further comprising:

the annular target goal post display further comprising at least one target goal post camera;

the at least one target goal post camera being concentrically positioned to the annular target goal post display;

the at least one target goal post camera being externally mounted to the illuminated light strobe conical frame; and the target camera being electrically connected to the main computing device.

22. The freestanding structural display apparatus for sport goalpost as claimed in claim 20 further comprising:

the annular target goal post display further comprising at least one conical electronic display panel;

the conical electronic display panel being perimetrically positioned around the illuminated light strobe conical frame;

the conical electronic display panel being externally mounted to the illuminated light strobe conical frame; and the conical electronic display panel being electrically connected to the main computing device.

23. The freestanding structural display apparatus for sport goalpost as claimed in claim 20 further comprising:

the annular target goal post display further comprising a net;

the net being perimetrically positioned around the illuminated light strobe conical frame; and the net being externally mounted to the illuminated light strobe conical frame.

24. The freestanding structural display apparatus for sport goalpost as claimed in claim 1 further comprising:

a first player platform;

a second player platform;

the advertising displaying freestanding media structure being centrally positioned in between the first player platform and the second player platform;

the sporting game-scoring structure being concentrically positioned atop the top panel;

the first player platform being diametrically opposed of the second player platform;

the first player platform and the second player platform each comprising a platform body, at least one sponsor display panel, a front platform camera, and a rear platform camera;

the at least one sponsor display panel being integrated onto the platform body;

the front platform camera and the rear platform camera being oppositely positioned of each other about the platform body;

the front platform camera and the rear platform camera being mounted to the platform body;

the front platform camera and the rear platform camera being oriented toward the advertising displaying free-standing media structure; and the front platform camera and the rear platform camera being electrically connected to the main computing device.

25. The freestanding structural display apparatus for sport goalpost as claimed in claim 1, wherein each of the plurality of electronic screen display panels is a transparent LED panel.

26. The freestanding structural display apparatus for sport goalpost as claimed in claim 1, wherein each of the plurality of electronic screen display panels is an opaque LED panel.

27. The freestanding structural display apparatus for sport goalpost as claimed in claim 1 further comprising:

a hospitality suite; and the hospitality suite being internally connected to the frame.

* * * * *